US007762546B2

(12) United States Patent
Wakakusa et al.

(10) Patent No.: US 7,762,546 B2
(45) Date of Patent: Jul. 27, 2010

(54) SHEET CONVEYING DEVICE AND IMAGE RECORDING APPARATUS INCLUDING THE SHEET CONVEYING DEVICE

(75) Inventors: Keisuke Wakakusa, Nagoya (JP); Masatoshi Izuchi, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 12/237,779

(22) Filed: Sep. 25, 2008

(65) Prior Publication Data

US 2009/0085279 A1 Apr. 2, 2009

(30) Foreign Application Priority Data

Sep. 28, 2007 (JP) ..... 2007-255668

(51) Int. Cl.
*B65H 31/00* (2006.01)

(52) U.S. Cl. ..... 271/207; 271/209; 271/224

(58) Field of Classification Search ..... 271/3.14, 271/9.01, 9.11, 207, 209, 224
See application file for complete search history.

(56) References Cited

U.S. PATENT DOCUMENTS 3,658,323 A * 4/1972 Matwey ..... 271/209
6,065,747 A * 5/2000 Khovaylo et al. ..... 271/209
6,231,043 B1 * 5/2001 James et al. ..... 271/209
6,550,763 B2 * 4/2003 Gordon et al. ..... 271/189
2008/0191410 A1 * 8/2008 Shinohara ..... 271/209

FOREIGN PATENT DOCUMENTS

JP H06-247608 A 9/1994
JP H08-119517 A 5/1996
JP H10-316299 A 12/1998

* cited by examiner

*Primary Examiner*—David H Bollinger
(74) *Attorney, Agent, or Firm*—Baker Botts L.L.P.

(57) ABSTRACT

A sheet conveying device including: (a) a sheet discharger configured to discharge a sheet in a discharging direction; (b) a tray configured to receive the sheet discharged by the sheet discharger; (c) a stopper protruding upwardly from the tray; and (d) a guide provided by an upper surface of the tray and located on an upstream side of the stopper in the discharging direction, and configured to warp the discharged sheet such that the warped sheet has a downwardly convex shape in its cross section that is perpendicular to the discharging direction, for thereby allowing a leading end of the warped sheet to pass over the stopper and to be positioned on a downstream side of the stopper in the discharging direction.

14 Claims, 15 Drawing Sheets

PRIOR ART

SHEET CONVEYING DEVICE AND IMAGE RECORDING APPARATUS INCLUDING THE SHEET CONVEYING DEVICE

CROSS REFERENCE TO RELATED APPLICATION

This application claims priority from Japanese Patent Application No. 2007-255668 filed on Sep. 28, 2007, the disclosure of which is herein incorporated by reference in its entirety.

BACKGROUND OF THE INVENTION

1. Field of the Invention

The present invention relates to a sheet conveying device for conveying a sheet so as to discharge the sheet onto a tray, and also to an image recording apparatus including the sheet conveying device.

2. Discussion of Related Art

In an image reading apparatus equipped with an automatic document feeder (ADF), a document disposed on a document tray is conveyed along a path, an image carried on the document is read in the process of conveyance of the document. After the image has been read, the document is discharged onto an exit tray. As an example of such an image reading apparatus, JP-H06-247608A discloses an apparatus in which a haul member and ribs are provided on an upper surface of an exit tray. Each of the ribs extends vertically from the upper surface of the exit tray and is elongated in a discharging direction in which a document is to be discharged. The haul member is provided by a plate-like member that is elongated in the discharging direction. An end fence is provided in an upstream end portion of the haul member in the discharging direction, while a tab is provided in a downstream end portion of the haul member in the discharging direction. After the document has been discharged onto the exit tray, a user slides the haul member in the discharging direction by operating the tab. The thus slid haul member is brought into contact with a trailing end of the document, and the document is moved along the ribs in the downstream direction.

JP-H10-316299A discloses a post-processing apparatus for stapling recording sheets after an image recording operation performed onto the recording sheets, and for discharging the stapled recording sheets onto an exit tray. In this post-processing apparatus, a pair of protruding members are provided on the exit tray. Specifically described, the protruding members are disposed on a contact portion of an upper surface of the exit tray, with which a sheaf of the discharged recording sheets hanging down is brought into contact at its leading end. The protruding members are located on respective opposite sides of a centerline of the exit tray (that extends in the discharging direction). Each of the protruding members has a gently inclined upper surface so as to have a height that is gradually reduced as viewed in a direction toward the centerline. Since the sheaf of the recording sheets is conveyed along the inclined upper surfaces of the respective protruding members, the sheaf is slightly warped at its leading end portion and accordingly given rigidity that restrains the sheaf from being rolled.

A conventional image recording apparatus such as an inkjet printer is provided with a sheet supplying cassette, which is constituted by a double-deck tray assembly including upper and lower portions that are provided by a sheet exit tray and a sheet supply tray, respectively. Each of the sheet tray and the sheet exit tray is expandable and contractible in the discharging direction so as to be capable of holding a recording sheet of any one of various sizes, so as to hold the sheet of a selected one of the various sizes. The sheet exit tray is provided with an extension tray for supporting a leading end portion of a recording sheet discharged onto the sheet exit tray. The extension tray is provided in a downstream end portion of the sheet exit tray in the discharging direction, and protrudes upwardly from an upper surface of the sheet exit tray. The recording sheet discharged onto the sheet exit tray is supported at its leading end by the extension tray, so as to be prevented from dropping from the sheet exit tray.

FIG. 15 is a perspective view showing a conventional sheet supplying cassette 149 with a state in which a recording sheet 137 discharged onto a sheet exit tray 144 has been brought into contact at its leading end with a stopper 148 so as to be stopped before discharge of the sheet 137 is completed. This state, which could be caused where the stopper 148 is movable in the discharging direction or the discharged recording sheet 137 has such a large length that its leading end reaches a downstream side of the stopper 148 in the discharging direction, could cause a risk of problematic jamming of the recording sheet 137. Such a problem could occur not only where the sheet supplying cassette 149 is used for supplying a recording sheet in an image recording apparatus but also where it is used for supplying a document in a scanner apparatus.

SUMMARY OF THE INVENTION

The present invention was made in view of the background prior art discussed above. It is therefore a first object of the invention to provide a sheet conveying device having an arrangement effective to advantageously prevent a problematic jamming of a sheet, which could be caused if the sheet discharged on a sheet exit tray were stopped before discharge of the sheet is completed. A second object of the invention is to provide an image recording apparatus including the sheet conveying device having such a technical advantage.

The first object may be achieved according to a first aspect of the invention, which provides a sheet conveying device including: (a) a sheet discharger configured to discharge a sheet in a discharging direction; (b) a tray configured to receive the sheet discharged by the sheet discharger; (c) a stopper protruding upwardly from the tray; and (d) a guide provided by an upper surface of the tray and located on an upstream side of the stopper in the discharging direction, and configured to warp the discharged sheet such that the warped sheet has a downwardly convex shape in a cross section thereof that is perpendicular to the discharging direction, for thereby allowing a leading end of the warped sheet to pass over the stopper and to be positioned on a downstream side of the stopper in the discharging direction.

The stopper is provided such that the leading end of the sheet discharged onto the tray is brought into contact with the stopper. Thus, owing to the stopper, the sheet is prevented from dropping from the tray. There is a case in which a length of the discharged sheet (as measured in the discharging direction) is larger than a distance between the stopper and a proximal end of the tray (as measured in the discharging direction), namely, a case in which the leading end of the discharged sheet is brought into contact with the stopper before discharge of the sheet by the sheet discharger is completed. In such as case, while the leading end of the sheet is being in contact with the stopper, the sheet is forced to be moved further in the discharging direction. However, in the sheet conveying device in which the guide is located on the upstream side of the stopper, the sheet is warped when being moved along the guide of the tray, so as to have the downwardly convex shape in the cross section perpendicular to the discharging direction. Owing to the downwardly convex shape in which its widthwise intermediate portion is downwardly convex relative to its widthwise opposite ends, the thus warped sheet is given a high degree of rigidity and is accordingly made difficult to be bent in the discharging direction, so that the sheet can pass over the stopper without the sheet being bent in the discharging direction, although the leading end of the sheet is brought into contact with the stopper. Consequently, it is possible to prevent jamming of the sheet. It is noted that the present sheet conveying device may be either used to either convey a recording sheet as the sheet in an image recording apparatus or used as an automatic document feeder to convey a document as the sheet in an image reading apparatus such as a scanner apparatus.

The second object may be achieved according to a second aspect of the invention, which provides an image recording apparatus including: the sheet conveying device described above; a second tray capable of holding a sheet of any one of various sizes, so as to hold the sheet of a selected one of the various sizes; an image recorder configured to record an image onto the sheet; and a sheet supplier capable of supplying the sheet from the second tray to the image recorder, so that the image is recorded onto the sheet supplied by the sheet supplier, wherein the sheet discharger is configured to discharge the sheet onto which the image has been recorded, onto the above-described tray as a first tray.

BRIEF DESCRIPTION OF THE DRAWINGS

The above and other objects, features, advantages and technical and industrial significance of the present invention will be better understood by reading the following detailed description of presently preferred embodiment of the invention, when considered in connection with the accompanying drawings, in which:

FIGS. 8A-8B is a set of views of the sheet exit tray 21 as seen from its upstream side, wherein FIG. 8A shows a state in which A5-sized sheet 128 is received on the tray 21, FIG. 8B shows a state in which A4-sized sheet 135 is received on the tray 21.

DETAILED DESCRIPTION OF THE PREFERRED EMBODIMENTS

There will be described an embodiment of the present invention, by reference to the accompanying drawings. It is noted that the embodiment will be described for illustrative purpose only and that the invention may be embodied with various changes, modifications and improvements, which may occur to those skilled in the art, without departing from the spirit of the invention defined in the appended claims.

Figure 1:
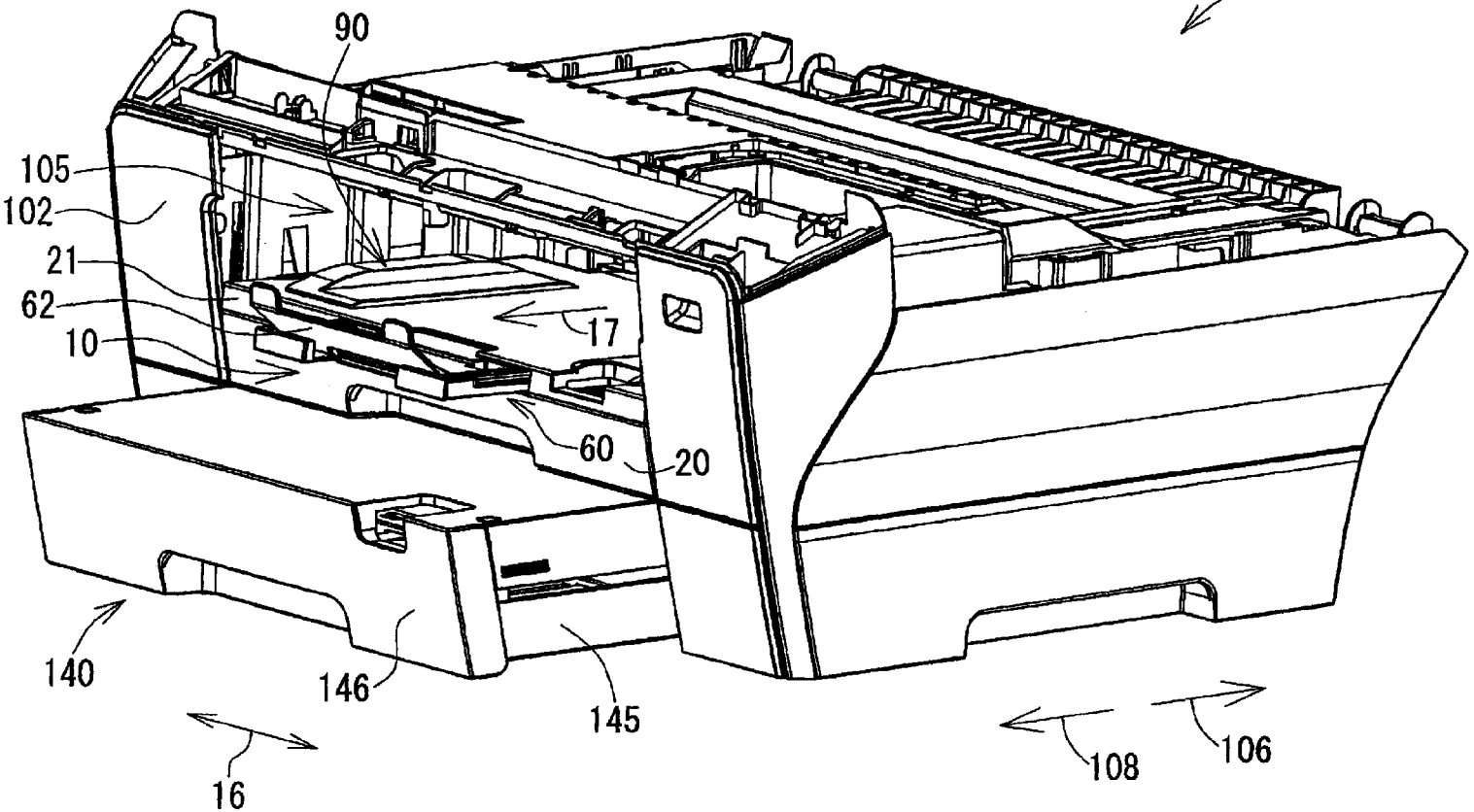
FIG. 1 is a perspective view showing a printer 100 in a state in which A4-sized sheets are held in an upper tray 20 while A3-sized sheets are held in a lower tray 140.

FIG. 1 shows an image recording apparatus in the form of an inkjet printer 100 that is constructed according to an embodiment of the invention. As shown in FIG. 1, the printer 100 has a generally rectangular parallelepiped shape, and its horizontal dimension (i.e., width and depth) is larger than its vertical dimension (i.e., height). The printer 100 has an opening 105 in its front side surface 102, thereby making it possible to introduce a sheet-supplying cassette 10 (see FIGS. 3 and 4) and a lower tray 140 (see FIG. 1) into a main body of the printer 100 via the opening 105, by moving them relative to the main body of the printer 100 in an introducing direction 106 (see FIG. 1). With the cassette 10 and the lower tray 140 being thus introduced in the main body of the printer 100, recording sheets held by an upper tray 20 of the cassette 10 or recording sheets held by the lower tray 140 can be supplied toward an image recorder 24 (see FIG. 2) of the printer 100. The cassette 10 and the lower tray 140 can be drawn out of the main body of the printer 100 via the opening 105, by moving them relative to the main body of the printer 100 in a drawing direction 108 (see FIG. 1). With the cassette 10 and the lower tray 140 being thus drawn out of the main body of the printer 100, the upper tray 20 and the lower tray 140 can be replenished with new recording sheets. In the present embodiment, recording sheets having a legal size are held by the upper tray 20 while recording sheets having another legal size are held by the lower tray 140. It is noted that, although the printer 100 is an inkjet multifunction apparatus including an image reader (FB scanner unit equipped with an automatic document feeder) which is provided on an upper side of the image recorder 24 and which is configured to read an image carried on a document, description of the image reader will not be provided. FIG. 1 shows a state in which the image reader is removed from a main body of the multifunction apparatus.

The sheet-supplying cassette 10 is constituted by a double-deck tray assembly including upper and lower portions that are provided by a sheet exit tray 21 as a first tray and the above-described upper tray 20, respectively. The upper tray 20 and the lower tray 140 serve as a second tray and a third tray, respectively, to hold recording sheets each of which is to be subjected to an image recording operation. In the present embodiment, the recording sheets are supplied, from a selected one of the upper and lower trays 20, 140, to the image recorder 24 that is configured to perform the image recording operation. After being subjected to the image recording operation, each of the recording sheets is discharged into the opening 105 so as to be received onto by the sheet exit tray 21 as the first tray.

Figure 2:
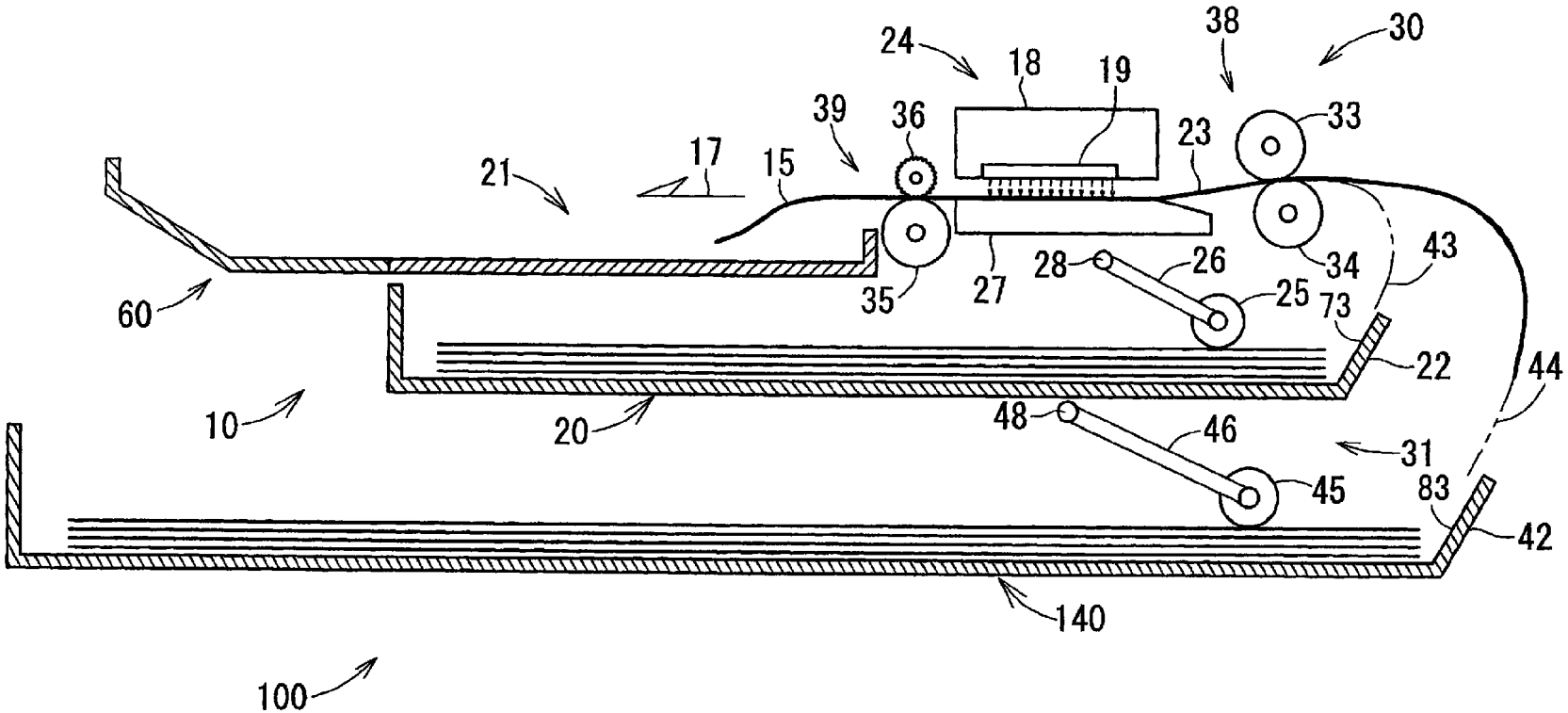
FIG. 2 is a view schematically showing an internal construction of the printer 100 of FIG. 1.

When the sheet-supplying cassette 10 is introduced in the main body of the printer 100, a slant plate 22 of the upper tray 20 of the cassette 10 is positioned below a first sheet path 43, as shown in FIG. 2. The slant plate 22 is inclined rightward as seen in FIG. 2, i.e., in a direction toward a back side of the printer 100. The recording sheets held by the upper tray 20 are guided upward by the slant plate 22 and are supplied to a first sheet path 43. The first sheet path 43 is a curved path along which the recording sheets supplied from the upper tray 20 are to be conveyed.

When the lower tray 140 is introduced in the main body of the printer 100, a slant plate 42 of the lower tray 140 is positioned below a second sheet path 44. The slant plate 42 is inclined rightward as seen in FIG. 2. The recording sheets held by the lower tray 140 are guided upward by the slant plate 42 and are supplied to a second sheet path 44. The second sheet path 44 is a curved path along which the recording sheets supplied from the lower tray 140 are to be conveyed.

The first sheet path 43 and the second sheet path 44 are both connected to a third sheet path 23. The third sheet path 23 is a path along which the recording sheets conveyed along the first sheet path 43 or the second sheet path 44 are to be conveyed. The third sheet path 23 extends leftward (as seen FIG. 2) up to the sheet exit tray 21.

The printer 100 has sheet pickup rollers 31 including a first pickup roller 25 and a second pickup roller 45, a selected one of which is rotated by a motor (not shown). The first pickup roller 25 is rotated to supply the recording sheets held by the upper tray 20, to the first sheet path 43 and third sheet path 23. The second pickup roller 45 is rotated to supply the recording sheets held by the lower tray 140, to the second sheet path 44 and third sheet path 23.

When the sheet-supplying cassette 10 is introduced in the main body of the printer 100, the first pickup roller 25 is positioned above the upper tray 20, as shown in FIG. 2. An arm 26 is pivotably held by a shaft 28 that is supported by a frame (not shown) of the printer 100. The first pickup roller 25 is pivotably held by a distal end portion of the arm 26. The arm 26 is constantly forced, by its own weight or an elastic force generated by a spring or the like, to be pivoted toward the upper tray 20. A drive force generated by the motor (not shown) is transmitted to the first pickup roller 25 through a power transmission mechanism (not shown) that is provided in the shaft 28 and the arm 26. When the drive force is transmitted to the first pickup roller 25 with the first pickup roller 25 being held in contact with an uppermost one of the recording sheets held by the upper tray 20, the uppermost recording sheet is picked up by the first pickup roller 25 and then supplied to the first sheet path 43 and third sheet path 23. It is noted that the arm 26 and the first pickup roller 25 are upwardly retracted when the sheet-supplying cassette 10 is to be removed from the main body of the printer 100 via the opening 105.

When the lower tray 140 is introduced in the main body of the printer 100, the second pickup roller 45 is positioned above the lower tray 140, as shown in FIG. 2. An arm 46 is pivotably held by a shaft 48 that is supported by the frame (not shown) of the printer 100. The second pickup roller 45 is pivotably held by a distal end portion of the arm 46. The arm 46 is constantly forced, by its own weight or an elastic force generated by a spring or the like, to be pivoted toward the lower tray 140. The drive force generated by the above-described motor (not shown) is transmitted to the second pickup roller 45 through a power transmission mechanism (not shown) that is provided in the shaft 48 and the arm 46. When the drive force is transmitted to the second pickup roller 45 with the second pickup roller 45 being held in contact with an uppermost one of the recording sheets held by the lower tray 140, the uppermost recording sheet is picked up by the second pickup roller 45 and then supplied to the second sheet path 44 and third sheet path 23. It is noted that the arm 46 and the second pickup roller 45 are upwardly retracted when the lower tray 140 is to be removed from the main body of the printer 100 via the opening 105.

The drive force generated by the above-described motor is given to the first pickup roller 25 or second pickup roller 45, whereby each recording sheet is supplied to a sheet conveyor 30 that is provided in the third sheet path 23, from a selected one of the upper tray 20 or lower tray 140.

A platen 27 is provided in the third sheet path 23, so as to support the recording sheet 15 (that is being conveyed along the third sheet path 23) from a lower side of the sheet 15. The image recorder 24 is disposed above the platen 27, so as to record an image onto the recording sheet 15 conveyed along the third sheet path 23. The image recorder 24 includes an inkjet recording head 19 and a carriage 18 that carries the recording head 19. The carriage 18 is movable in a horizontal direction (i.e., in a direction perpendicular to a drawing sheet of FIG. 2) that is perpendicular to the discharging direction 17. The recording head 19 is disposed on a bottom surface of the carriage 18 such that nozzles of the recording head 19 are exposed in the bottom surface of the carriage 18 and face downwardly. An ink is supplied to the recording head 19 from each ink cartridge (not shown) that is disposed inside the printer 100. While the carriage 18 is being moved, the recording head 19 ejects the ink in the form of minute droplets, through selected ones of the nozzles, toward the platen 27, so that a desired image is formed onto the recording sheet 15 that is being conveyed on an upper side of the platen 27 along the third sheet path 23.

The sheet conveyor 30, which is provided in the third sheet path 23, includes a pair of feeding roller set 38 and a pair of discharging roller set 39. The feeding roller set 38 is disposed on an upstream side of the image recorder 24 in the discharging direction 17, and consists of a feeding roller 33 and a pinch roller 34. The pinch roller 34 is freely rotatably held, and is constantly forced or biased toward the feeding roller 33 by a spring or the like. The discharging roller set 39 is disposed on a downstream side of the image recorder 24 in the discharging direction 17, and consists of a discharging roller 35 and a spur roller (rowel) 36. The spur roller 36 is freely rotatably held, and is constantly forced or biased toward the discharging roller 35 by a spring or the like.

A gear drive mechanism (not shown) including a plurality of gears is connected to a shaft of the feeding roller 33, so that the rotary drive force generated by the motor is transmitted to the shaft of the feeding roller 33. By the transmission of the drive force to the shaft of the feeding roller 33, the feeding roller 33 is rotated at a certain rotational velocity whereby the recording sheet 15 gripped between the feeding roller 33 and the pinch roller 34 is fed onto the platen 27. The feeding roller 33 and the discharging roller 35 are connected to each other via a transmission mechanism that includes gears, so that the drive force is transmitted from the feeding roller 33 to the discharging roller 35 via the transmission mechanism whereby the feeding and discharging rollers 33, 35 are driven in synchronization with each other. Thus, the recording sheet 15 gripped between the discharging roller 35 and the spur roller 36 is moved in the discharging direction 17 so as to be discharged onto the sheet exit tray 21 via the third sheet path 23. The recording sheet 15 supplied from the upper tray 20 or the lower tray 140 is subjected to a recording operation while being conveyed along the third sheet path 23 above the platen 27 by the feeding roller set 38 and the discharging roller set 39, and is then received onto the sheet exit tray 21.

Figure 3:
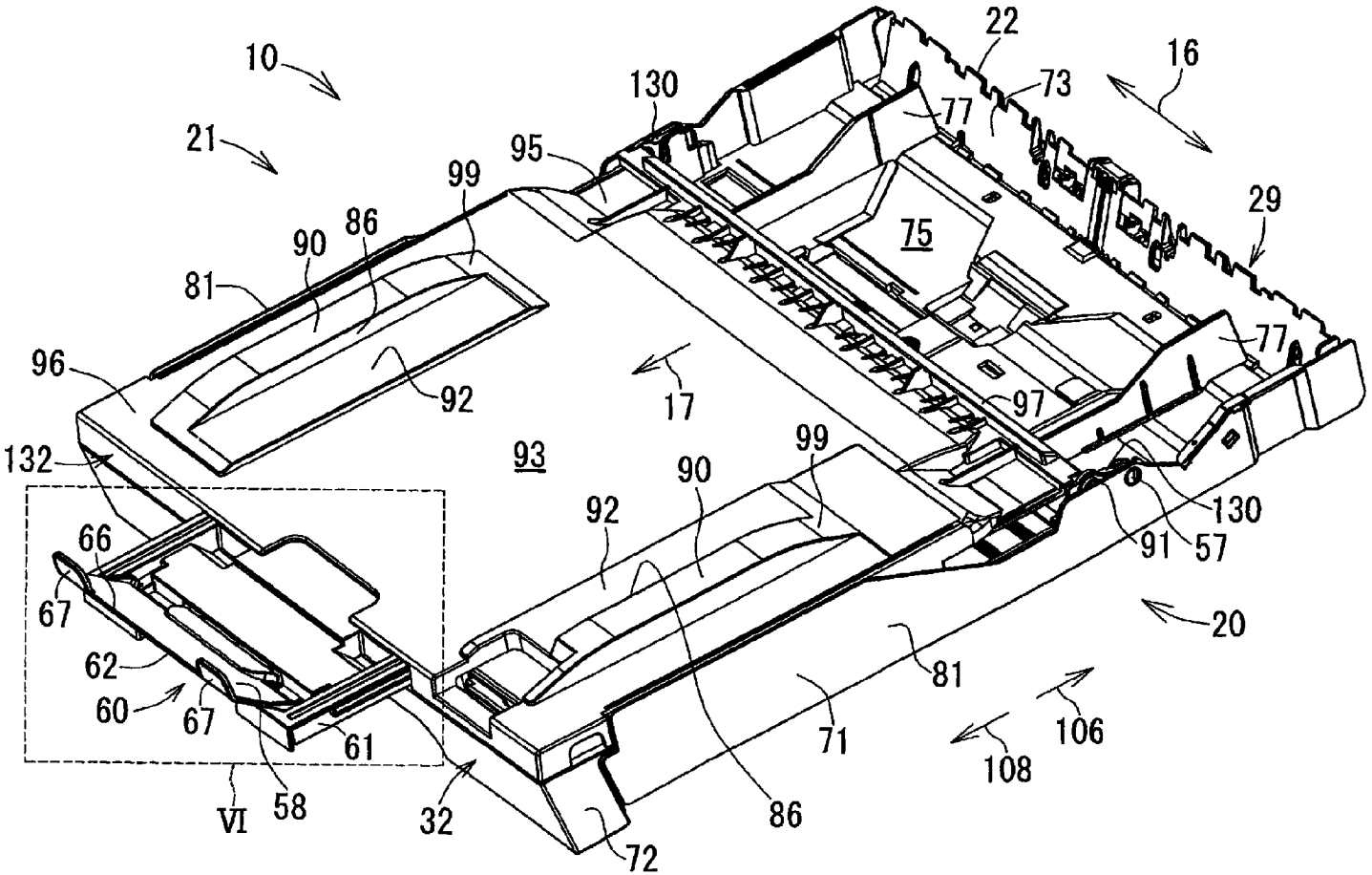
FIG. 3 is a perspective view showing a sheet-supplying cassette 10 in a state in which an extension tray 60 is drawn out of a sheet exit tray 21.
Figure 4:
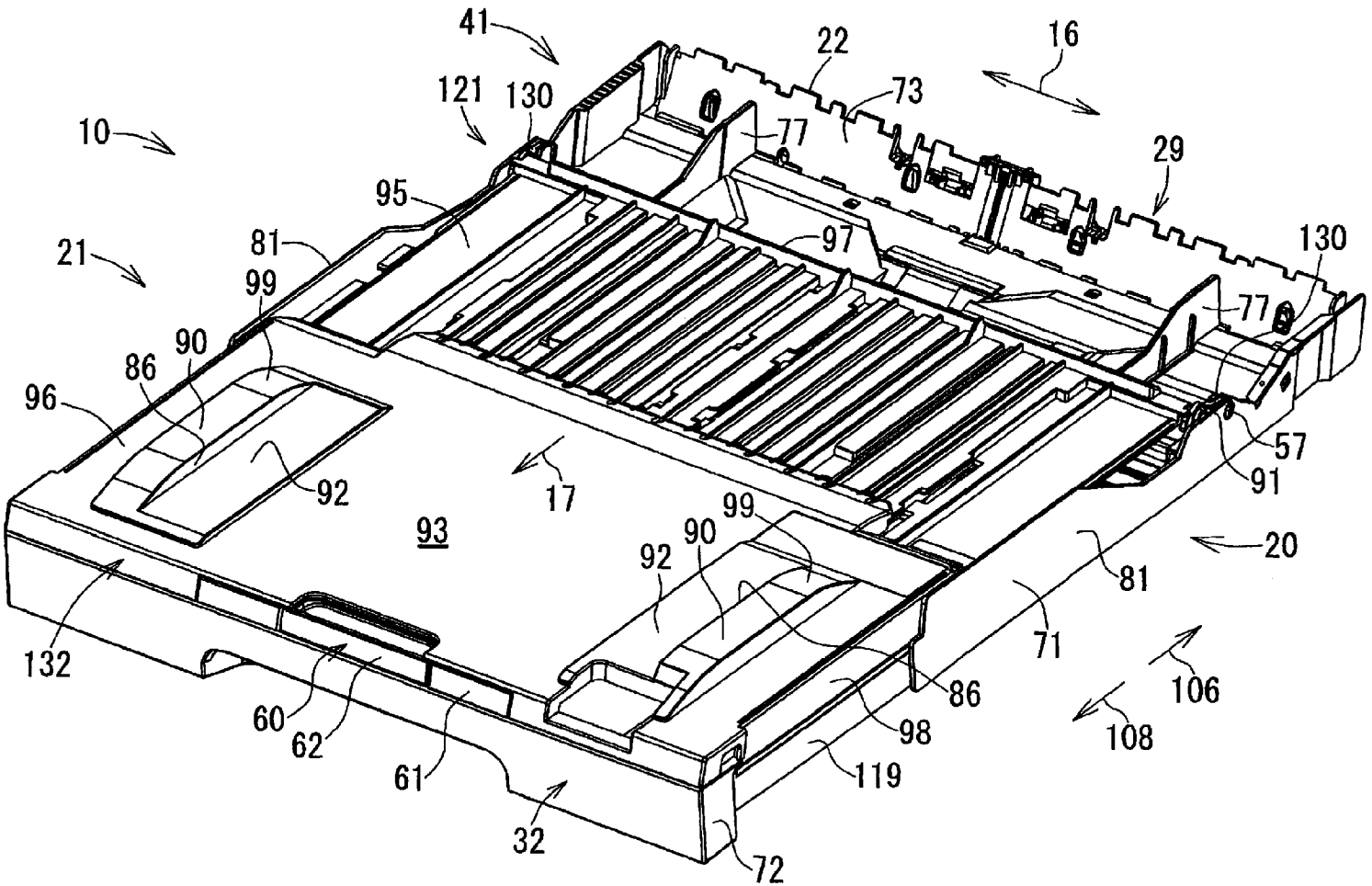
FIG. 4 is a perspective showing the sheet-supplying cassette 10 in a state in which the cassette 10 is expanded.
Figure 5:
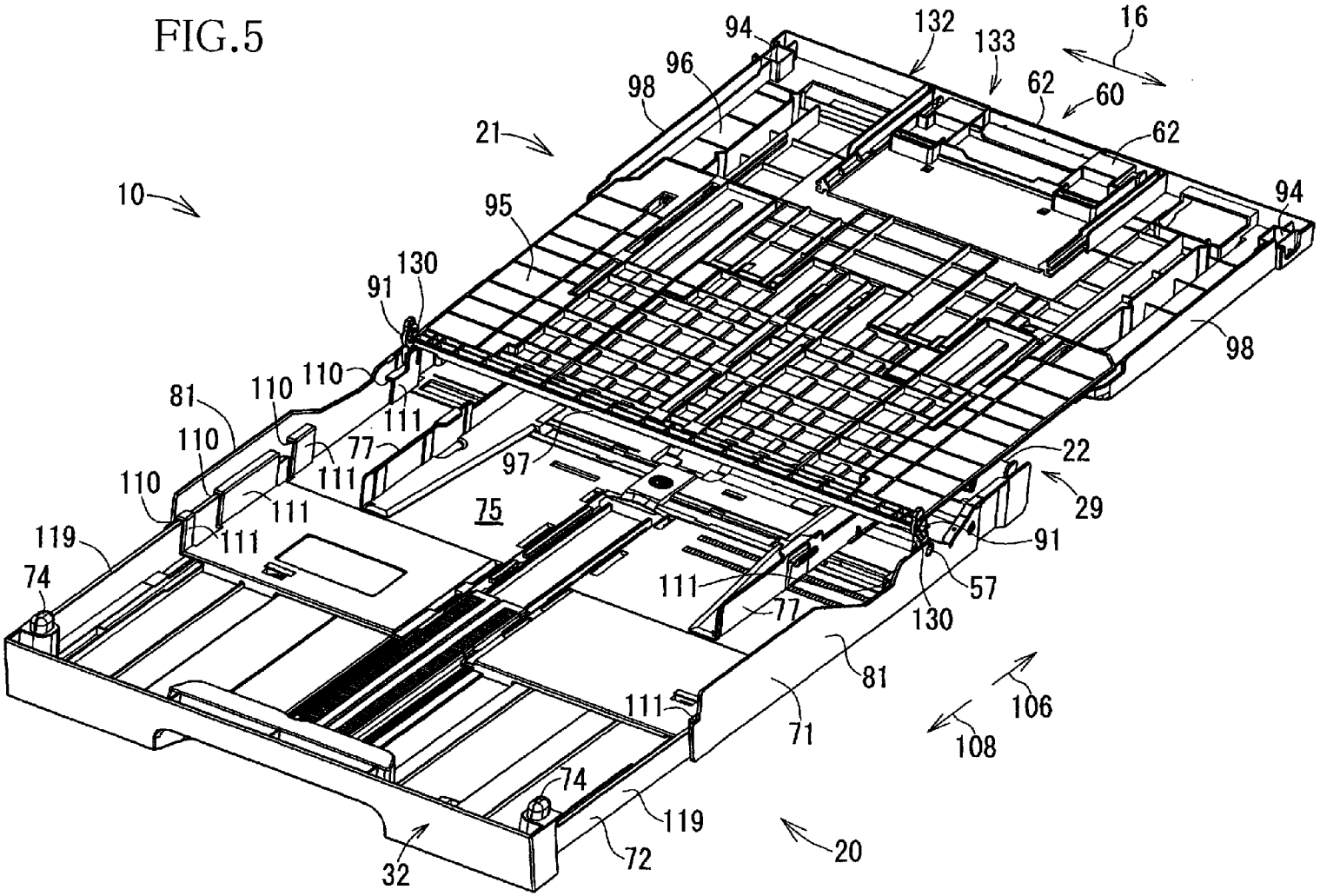
FIG. 5 is a perspective showing the sheet-supplying cassette 10 in a state in which a sheet exit tray 21 has been pivoted toward a front end 29 of the upper tray 20.

Referring next to FIGS. 3-5, there will be described a construction of the upper tray 20. As shown in FIG. 3, the upper tray 20 has a rectangular plate-like shape that is elongated in the introducing direction 106 and drawing direction 108. The upper tray 20 has a tray main body 71 and an expansion tray 72 that is slidingly movable relative to the tray main body 71 in the introducing direction 106 and drawing direction 108. Thus, the expansion tray 72 is slidingly moved relative to the tray main body 71 as needed in the introducing direction 106 or drawing direction 108. By the movement of the expansion tray 72 relative to the tray main body 71, an upper surface (i.e., a sheet receiving surface) of the upper tray 20 is expanded or contracted so that the upper tray 20 can hold various kinds of recording sheets (that are different in size) such as A3-sized sheet (420 mm×297 mm), A4-sized sheet (297 mm×210 mm), B5-sized sheet (257 mm×182 mm), postcard-sized sheet (148 mm×100 mm), legal-sized sheet (8.5 inch×14 inch) and letter-sized sheet (8.5 inch×11 inch). The upper tray 20 holds recording sheets of a selected one of the various kinds.

The tray main body 71 of the upper tray 20 has a bottom plate 75 (see FIG. 5) on which recording sheets are to be set. The above-described slant plate 22 is provided in an end portion of the bottom plate 75 that constitutes a front end 29 of the upper tray 20 (see FIGS. 3 and 4). The slant plate 22 is provided by a plate-like member that is elongated in a width direction 16 (i.e., a direction perpendicular to the discharging direction 17) of the tray main body 71. The slant plate 22 is inclined in the direction toward the back side of the printer 100, as described above. When each of the recording sheets accommodated in the upper tray 20 is brought into contact at its leading end with the slant plate 22, the leading end of each sheet is guided along an inside surface 73 of the slant plate 22 in a diagonally upward direction toward the first sheet path 43.

A pair of side guide plates 77 are provided in the tray main body 71. When one of the side guide plates 77 is slidingly moved in a direction parallel to the width direction 16, the other of the side guide plates 77 is slidingly moved in a direction opposite to the direction of the movement of the one of side guide plates 77. That is, the pair of side guide plates 77 are moved in association with each other in respective opposite directions that are parallel to the width direction 16. For example, where the recording sheets set on the upper tray 20 have a width smaller than a distance between the two side guide plates 77, it is possible to cause the two side guide plates 77 to be moved toward each other concurrently with each other, by moving one of the two side guide plates 77 toward the recording sheets. Owing to the movements of the respective two side guide plates 77, it is possible to substantially align a widthwise center of the recording sheets with a widthwise center of the upper tray 20.

The tray main body 71 further has a pair of side walls 81 that are provided on respective end portions of the bottom plate 75 that are opposite to each other in the width direction 16. The side walls 81 extend in the introducing direction 106 and drawing direction 108, and have respective receiver holes 57 such that shafts of respective links 130 are rotatably received in the respective receiver holes 57 (see FIG. 5). The links 130 are pivotably connected to the upper tray 20 through their respective shafts that are rotatably received in the respective receiver holes 57.

A plurality of side end guides 111 are provided inside each of the side walls 81 of the tray main body 71, and are arranged in the introducing direction 106, as shown in FIG. 5. Each of the side end guides 111 has a guide groove 110, so as to have an inverted U shape in its cross section. By the guide groove 110, directions of the sliding movement of the expansion tray 72 are limited to the introducing direction 106 and drawing direction 108. The expansion tray 72 has a pair of rails 119 that are introduced in the guide grooves 110 of the side end guides 111.

A rear guide (not shown) is provided in a central portion of the expansion tray 72 in the width direction 16, so as to be slidingly movable in the introducing direction 106 and drawing direction 108. When the recording sheets are accommodated in the upper tray 20, the rear guide is slidingly moved in the introducing direction 106 so as to be brought into contact with trailing ends of the respective recording sheets. Owing to the rear guide, the trailing ends of the respective recording sheets are made flush with each other and are all positioned in a position that is dependent on a size of the recording sheets, while leading ends of the respective recording sheets are all positioned in a predetermined position close to the slant plate 22 within the upper tray 20, irrespective of the size of the recording sheets.

The above-described pair of rails 119 are provided in respective end portions of the expansion tray 72 which are opposite to each other in the width direction 16, so as to be introduced in the guide grooves 110 of the tray main body 71 (see FIGS. 4 and 5). The rails 119 extend in the introducing direction 106, and constitute respective side walls of the expansion tray 72. Each of the rails 119 is positioned in a suitable position and has a suitable shape for enabling itself to be introduced in the guide grooves 110.

As shown in FIG. 5, a pair of protrusions 74 are provided in respective opposite end portions of a rear end 32 of the expansion tray 72 which are opposite to each other in the width direction 16. The protrusions 74 protrude upwardly from the expansion tray 72, and are receivable in respective recesses 94 of an expansion tray 96 of the sheet exit tray 21. Each of the protrusions 74 is positioned in a suitable position and has a suitable shape for enabling itself to be received in a corresponding one of the recesses 94.

There will be described a construction of the sheet exit tray 21, with reference to FIGS. 3-5. The sheet exit tray 21 has a tray main body 95 in addition to the expansion tray 96. The expansion tray 96 is slidingly movable relative to the tray main body 95 in the introducing direction 106 and drawing direction 108. In other words, the sheet exit tray 21 is expandable and contractible in the drawing direction 108 (that is the same to the discharging direction 17) and the introducing direction 106.

The tray main body 95 of the sheet exit tray 21 has a generally rectangular shape, in its plan view, which is elongated in the width direction 16. A pair of shafts 91 are provided in respective opposite ends of a front end 97 of the tray main body 95, so as to protrude outwardly in the width direction 16 (see FIG. 5). The shafts 91 are rotatably received in receiver holes of the respective links 130, whereby the sheet exit tray 21 is pivotably connected to the upper tray 20.

The expansion tray 96 also has a generally rectangular shape, in its plan view, which is elongated in the width direction 16. A width of the expansion tray 96 is slightly smaller than a distance between the side walls 81 of the tray main body 71, so that inside surfaces of respective side walls 98 of the expansion tray 96 are brought into contact with upper surfaces of the respective side end guides 111 so as to be supported from their lower sides by the upper surfaces of the respective side end guides 111, when the sheet exit tray 21 is pivoted relative to the upper tray 20 in a covering direction for covering an upper opening of the upper tray 20. On an upper surface 93 of the expansion tray 96, there are provided a pair of ridge portions 90 (see FIG. 4).

As shown in FIG. 5, the above-described recesses 94 are provided in respective opposite end portions of a rear end 132 of the expansion tray 96 which are opposite to each other in the width direction 16. The recesses 94 are recessed from a bottom surface of the expansion tray 96 toward the upper surface 93 of the expansion tray 96. Each of the recesses 94 is positioned in a suitable position and has a suitable shape for enabling itself to receive therein a corresponding one of the above-described protrusions 74, so that the protrusions 74 are received in the respective recesses 94 when the sheet exit tray 21 has been pivoted relative to the upper tray 20 in the covering direction for covering the upper opening of the upper tray 20. In this state in which the upper opening of the upper tray 20 is covered by the sheet exit tray 21, the expansion tray 96 of the sheet exit tray 21 is supported from its lower side by the expansion tray 72 of the upper tray 20, with an sliding movement of the expansion tray 96 relative to the expansion tray 72 being restricted owing to engagements of the protrusions 74 with the respective recesses 94. Therefore, when the expansion tray 72 is slidingly moved relative to the tray main body 71 in the introducing direction 106 or drawing direction 108, the expansion tray 96 is slidingly moved in the same direction as the expansion tray 72. Consequently, the sheet exit tray 21 is expandable and contractible integrally with the upper tray 20, with the upper opening of the upper tray 20 being kept covered by the sheet exit tray 21.

An accommodation space 133 is provided in the bottom surface of the expansion tray 96, and is located in the vicinity of the rear end 132 of the expansion tray 96. The accommodation space 133 is provided for accommodating therein an extension tray 60, and accordingly has such a size that enables the extension tray 60 to be accommodated therein. A pair of rails (not shown) are provided on respective side walls that cooperate with each other to define the accommodation space 133. Each of the rails protrudes from a corresponding one of the side walls toward a widthwise center of the expansion tray 96, and extends in the introducing direction 106 and drawing direction 108. Each of the rails is introduced in a corresponding one of guide grooves 65 (see FIG. 6) of the extension tray 60. Accordingly, each of the rails is positioned in a suitable position and has a suitable shape for enabling itself to be introduced in a corresponding one of the guide grooves 65. It is noted that the accommodation space 133 is located in a central portion of the sheet exit tray 21 in the width direction 16, so that a widthwise center of the extension tray 60 and a widthwise center of the sheet exit tray 21 are substantially aligned with each other in the width direction 16 when the extension tray 60 is drawn in the drawing direction 108.

Referring back to FIGS. 1 and 2, there will be described a construction of the lower tray 140. As shown in FIG. 1, the lower tray 140 has a rectangular plate-like shape that is elongated in the introducing direction 106 and drawing direction 108. The lower tray 140 has a tray main body 145 and an expansion tray 146 that is slidingly movable relative to the tray main body 145 in the introducing direction 106 and drawing direction 108. A sliding mechanism for enabling the sliding movement of the expansion tray 146 relative to the tray main body 145 is substantially the same to that for enabling the sliding movement of the expansion tray 72 relative to the tray main body 71. Thus, the expansion tray 146 is slidingly moved relative to the tray main body 145 as needed in the introducing direction 106 or drawing direction 108. By the movement of the expansion tray 146 relative to the tray main body 145, an upper surface (i.e., a sheet receiving surface) of the lower tray 140 is expanded or contracted so that the lower tray 140 can hold various kinds of recording sheets (that are different in size) such as A3-sized sheet (420 mm×297 mm), A4-sized sheet (297 mm×210 mm), B5-sized sheet (257 mm×182 mm), postcard-sized sheet (148 mm×100 mm), legal-sized sheet (8.5 inch×14 inch) and letter-sized sheet (8.5 inch×11 inch). The lower tray 140 holds recording sheets of a selected one of the various kinds.

FIG. 1 shows a state in which A4-sized sheets are held by the upper tray 20 while A3-sized sheets are held by the lower tray 140. Thus, the lower tray 140 is capable of holding sheets different in size from those held by the upper tray 20. Differently from the state shown in FIG. 1, it is also possible that A3-sized sheets are held by the upper tray 20 while A4-sized sheets are held by the lower tray 140.

The above-described slant plate 42 is provided in a rightmost end portion of the tray main body 145 as seen in FIG. 2. The slant plate 42 is provided by a plate-like member that is elongated in a width direction (i.e., a direction perpendicular to drawing sheet of FIG. 2) of the tray main body 145. The slant plate 42 is inclined in the introducing direction 106, i.e., in the direction toward the back side of the printer 100, as described above. When each of the recording sheets accommodated in the lower tray 140 is brought into contact at its leading end with the slant plate 42, the leading end of each sheet is guided along an inside surface 83 of the slant plate 42 in a diagonally upward direction toward the second sheet path 44.

The lower tray 140 is provided with side guide plates and a rear guide, description of which will not be provided since they are substantially the same to the above-described side guide plates and the rear guide of the upper tray 20.

Figure 6:
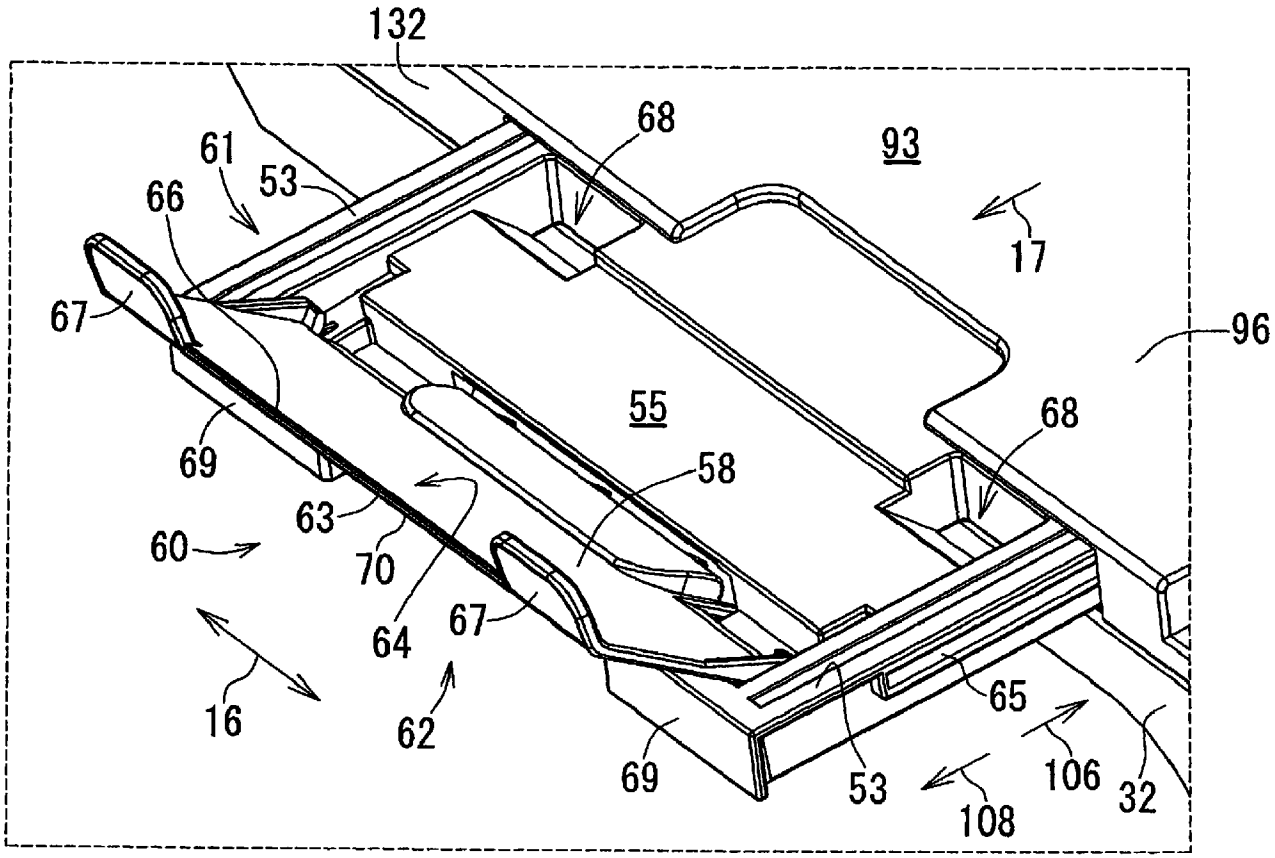
FIG. 6 is a view showing, in enlargement, a part VI of FIG. 3.

Referring next to FIG. 6, there will be described a construction of the extension tray 60. The extension tray 60 is constituted principally by a tray main body 61 and a stopper 62. The tray main body 61 has a generally thin rectangular parallelepiped shape, and its width dimension (i.e., a dimension in the width direction 16) is larger than its depth dimension (i.e., a dimension in the introducing direction 106). The tray main body 61 has substantially the same shape as the accommodation space 133, and is slightly smaller than the accommodation space 133. The above-described guide grooves 65 are provided in respective side surfaces of the tray main body 61 which are opposite to each other in the width direction 16. The guide grooves 65 extend in the introducing direction 106 and drawing direction 108, and are provided by respective recesses, which are formed in the respective opposite side surfaces so as to be recessed toward a widthwise central portion of the tray main body 61 in the width direction 16. Each of the above-described rails of the expansion tray 96 is introduced in a corresponding one of the guide grooves 65. Each of the guide grooves 65 is positioned in a suitable position and has a suitable shape for enabling the introduction of a corresponding one of the rails therein. With the introductions of the rails in the respective guide grooves 65, the tray main body 61 is held by the expansion tray 96, and is slidingly movable in the introducing direction 106 and drawing direction 108. FIG. 6 shows a state in which the tray main body 61 has been slidingly moved in the drawing direction 108. With the tray main body 61 being drawn from the expansion tray 96 in the drawing direction 108, a sheet receiving surface of the sheet exit tray 21 is extended in the drawing direction 108. The tray main body 61 is accommodated into the accommodating space 133, when the tray main body 61 is slidingly moved in the introducing direction 106 (see FIG. 4).

As shown in FIG. 6, a pair of recesses 68 are provided in respective opposite end portions of an upper surface 55 of the tray main body 61, which are opposite to each other in the width direction 16. The recesses 68 are recessed toward a lower side of the upper surface 55 of the tray main body 61. The stopper 62 is held by the tray main body 61, pivotably about a pivot axis parallel to the width direction 16. The recesses 68 receive therein respective protruding contact portions 67 when the stopper 62 has been pivoted toward the upper surface 55 of the tray main body 61. Each of the recesses 68 is positioned in a suitable position and has a suitable shape for enabling itself to receive therein a corresponding one of the protruding contact portions 67.

The upper surface 55 of the tray main body 61 is a surface with which the stopper 62 is brought into contact when the stopper 62 is pivoted toward the upper surface 55. This upper surface 55 is located in a position that becomes lower than an upper surface 53 of the extension tray 60 when the stopper 62 has been pivoted onto the upper surface 55 of the tray main body 61, so that the stopper 62 is positioned in a position lower than the upper surface 53 when the stopper 62 has been pivoted onto the upper surface 55 of the tray main body 61. Therefore, when the tray main body 61 is introduced into the accommodation space 133 with the stopper 62 being pivoted onto the upper surface 55 of the tray main body 61, the tray main body 61 can be accommodated in the accommodation space 133 without the stopper 62 interfering the expansion tray 96.

The tray main body 61 has a pair of shaft receivers (not shown) provided in their respective portions that are close to a rear end portion 69 of the tray main body 61. The stopper 62 has a pair of shafts (not shown) that are rotatably received in the respective shaft receivers of the tray main body 61.

Figure 9:
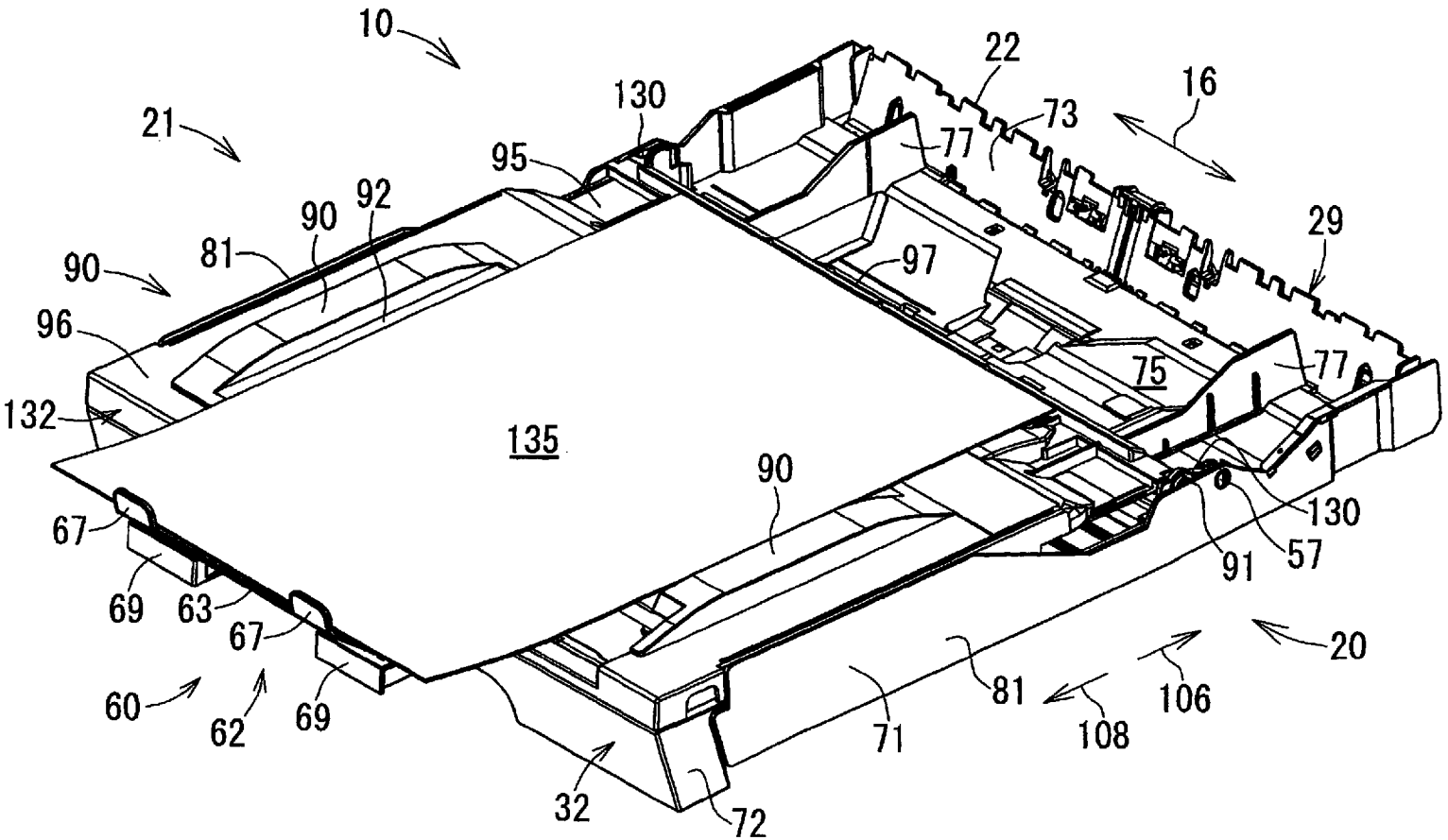
FIG. 9 is a perspective view showing the sheet-supplying cassette 10 in a state in which A-4 sized sheet 135 is received on the sheet exit tray 21.

The stopper 62 serves to stop leading ends of respective recording sheets received on the sheet exit tray 21 (see FIG. 9). The stopper 62 is provided in the tray main body 61 that is to be drawn out of the sheet exit tray 21 in the drawing direction 108. In other words, the stopper 62 is provided in a downstream end portion of the sheet exit tray 21 in the discharging direction 17 that is the same to the drawing direction 108 (see FIG. 3).

The stopper 62 is constituted principally by a guide plate 63 and a pair of protruding contact portions 67. The guide plate 63 is provided for guiding the leading end of each recording sheet discharged in the discharging direction 17, in a diagonally upward direction toward the protruding contact portions 67. The guide plate 63 is provided by a thin plate-like member that is elongated in the width direction 16. The guide plate 63 has the above-described shafts projecting from its respective opposite ends outwardly in the width direction 16. With the shafts being received in the above-described shaft receivers of the tray main body 61, the stopper 62 is held by the tray main body 61 and pivotable relative to the tray main body 61 about a pivot axis parallel to the width direction 16. Thus, the stopper 62 is pivotable between an inclined-posture position in which the stopper 62 has been pivoted in the drawing direction 108 (see FIG. 6) and a lying-posture position in which the stopper 62 has been pivoted onto the upper surface 55 of the tray main body 61.

With the stopper 62 being positioned in the lying-posture position, the guide plate 63 is in contact with the upper surface 55 so as to be supported from its lower side by the upper surface 55. In this state, the guide plate 63 is positioned on a lower side of the upper surface 53 of the extension tray 60, and the protruding contact portions 67 are received in the respective recesses 68, so that the tray main body 61 is allowed to be slidingly moved in the introducing direction 106. With the tray main body 61 being moved relative to the expansion tray 96 in the introducing direction 106 or drawing direction 108, the stopper 62 is moved together with the tray main body 61 in the same direction. Further, as described above, the sheet exit tray 21 is constructed such that the expansion tray 96 is slidingly movable relative to the tray main body 95 in the introducing direction 106 or drawing direction 108. Therefore, when the expansion tray 96 is moved with the stopper 62 being held in the above-described inclined-posture position, the stopper 62 is moved together with the expansion tray 96 in the same direction. Thus, the stopper 62 is movable in the discharging direction 17.

With the stopper 62 being positioned in the inclined-posture position, as shown in FIG. 6, the guide plate 63 is in contact with an upper end of the rear end portion 69 of the tray main body 61 so that pivot movement of the stopper 62 is stopped whereby the stopper 62 is held in the inclined-posture position. With the stopper 62 being thus held in the inclined-posture position, the guide plate 63 and the protruding contact portions 67 protrude so as to be positioned on an upper side of the upper surface 93 of the expansion tray 96, and the guide surface 58 of the guide plate 63 is open upwardly. The guide surface 58 is inclined with respect to the upper surface 93 of the expansion tray 96, toward an upstream side in the discharging direction 17. Each of the recording sheets discharged onto the sheet exit tray 21 is moved along the guide surface 58 in a diagonally upward direction, whereby the leading end of each recording sheet is guided to the protruding contact portions 67. In the present embodiment, the guide surface 58 is provided by a flat surface.

The protruding contact portions 67 protrude from a distal end 70 of the guide plate 63. More precisely, the protruding contact portions 67 protrude from respective end portions of the distal end 70 which are opposite to each other in the width direction 16. The protruding contact portions 67 are provided for stopping the leading end of each recording sheet guided by the guide surface 58. The guide plate 63 has a cutout 66 which is located between the protruding contact portions 67 in the width direction 16. The cutout 66 constitutes a space 64 defined between the protruding contact portions 67 in the width direction 16, and serves as a non-contact portion.

The protruding contact portions 67, which protrude from the distal end 70 of the guide plate 63, are inclined with respect to the guide plate 63, such that each of the protruding contact portions 67 and the guide plate 63 cooperates with each other to define an obtuse angle therebetween. Therefore, in the present embodiment, the protruding contact portions 67 protrude from the distal end 70 substantially in an upright direction. As described later more in detail, an A3-sized sheet 137 is warped to have a downwardly convex shape in its leading end while being conveyed along the sheet exit tray 21 (see FIG. 8C). The protruding contact portions 67 are located in respective positions corresponding to respective portions of the leading end of the warped sheet 137 that are located on respective opposite sides of a curved central portion 123 of the leading end of the warped sheet 137. That is, the protruding contact portions 67 are located in the respective positions that allow the contact portions 67 to be in contact with the respective portions of the leading end of the warped sheet 137 each of which is located between the curved central portion 123 and a corresponding one of opposite end portions 124 of the leading end. Meanwhile, the space 64 is located in a position corresponding to the curved central portion 123. Owing to the space 64, the stopper 62 is not in contact with the curved central portion 123 of the leading end of the warped sheet 137.

Figure 7:
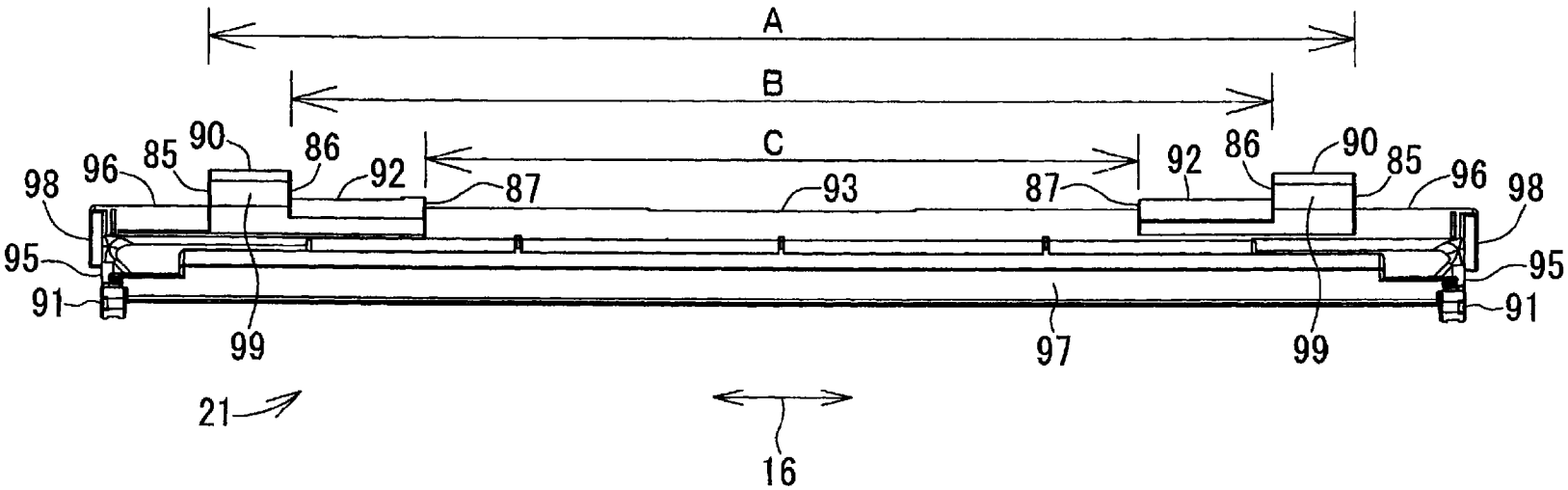
FIG. 7 is a view showing the sheet exit tray 21 as seen from its upstream side in a discharging direction 17.
Figure 8A:
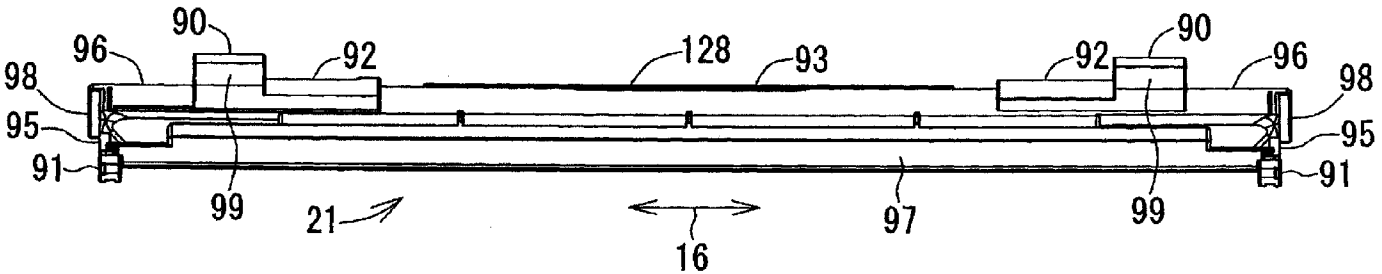

Referring next to FIGS. 3, 7 and 8, there is described a construction of a guide that is provided by an upper surface of the sheet exit tray 21 as the firs tray. In the present embodiment, the guide is constituted principally by the upper surface 93 of the expansion tray 96, the above-described pair of ridge portions 90 and a pair of plateau portions 92. As shown in FIG. 3, the ridge portions 90 are elongated or extend in the discharging direction 17, and disposed in respective portions of the upper surface 93 of the expansion tray 96, which are close to respective ends of the upper surface 93 that are opposite to each other in the width direction 16. The stopper 62 is located on a downstream side of the rear end 132 of the sheet exit tray 21 in the discharging direction 17. In other words, the ridge portions 90 are located on an upstream side of the stopper 62 in the discharging direction 17.

The guide includes: widthwise opposite end portions which are opposite to each other in the width direction 16; and a widthwise intermediate portion which is located between the widthwise opposite end portions in the width direction 16, such that each of the widthwise opposite end portions has a height larger than a height of the widthwise intermediate portion. In the present embodiment, the widthwise opposite end portions are provided by the ridge portions 90 as upwardly protruding portions, while the widthwise intermediate portion is provided by a widthwise intermediate portion of the upper surface 93 in the width direction 16. The pair of plateau portions 92 are located inside the respective ridge portions 90 and outside the widthwise intermediate portion of the upper surface 93 in the width direction 16. The plateau portions 92 have a height which is sufficiently smaller than the height of the ridge portions 90 and which is slightly larger than the height of the widthwise intermediate portion of the upper surface 93, so that a large step is defined between each of the ridge portions 90 and a corresponding one of the plateau portions 92, and a small step is defined between each of the plateau portions 92 and the widthwise intermediate portion of the upper surface 93. The plateau portions 92 as well as the ridge portions 90 extend in the discharging direction 17.

The ridge portions 90 and the plateau portions 92 are arranged as shown in FIG. 7. Specifically described, outside walls 85 of the respective ridge portions 90 are distant from each other by a distance A that is slightly smaller than a width (297 mm) of the A3-sized sheet 137 (see FIGS. 7 and 8C). Inside walls 86 of the respective ridge portions 90 are distant from each other by a distance B that is slightly larger than a width (210 mm) of an A4-sized sheet 135 (see FIGS. 7 and 8B). Inside walls 87 of the respective plateau portions 92 are distant from each other by a distance C that is slightly larger than a width (148 mm) of an A5-sized sheet 128 (see FIGS. 7 and 8A). That is, the ridge portions 90 are located in respective positions which are located outside widthwise opposite ends of the A4-sized sheet 135 and inside widthwise opposite ends of the A3-sized sheet 137 in the width direction 16. The plateau portions 92 are located in respective positions which are located outside widthwise opposite ends of the A5-sized sheet 128 and inside widthwise opposite ends of the A4-sized sheet 135 in the width direction 16.

As shown in FIG. 3, an inclined surface 99 is provided on an upstream side of each of the ridge portions 90 in the discharging direction 17. The inclined surface 99 interconnects an upper surface of each of the ridge portions 90 and a non-protruding portion of the upper surface 93, and is inclined upwardly with respect to the non-protruding portion of the upper surface 93.

Figure 8B:
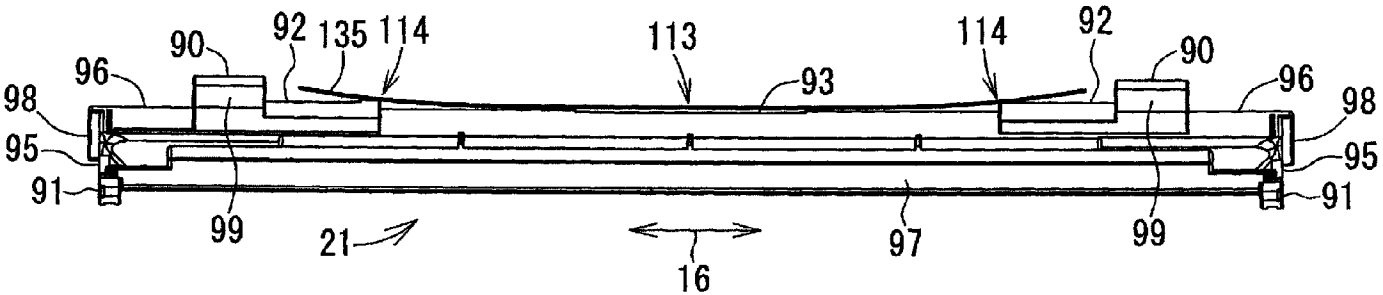
Figure 8C:
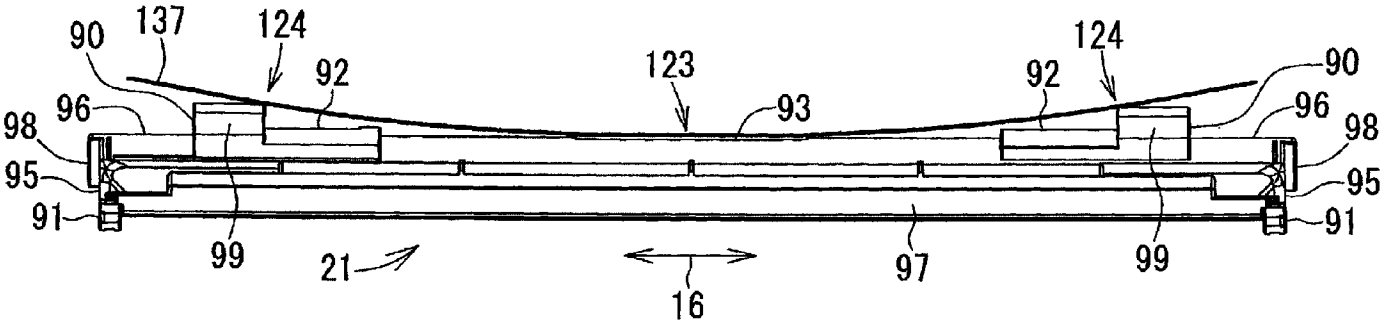
FIG. 8C shows a state in which A3-sized sheet 137 is received on the tray 21.

As shown in FIG. 8C, when the A3-sized sheet 137 is discharged onto the sheet exit tray 21, the sheet 137 is conveyed in the discharging direction, with the widthwise central portion (curved central portion) 123 of the leading end of the sheet 137 being moved along the widthwise intermediate portion of the upper surface 93 of the expansion tray 96. Meanwhile, the widthwise opposite end portions 124 of the leading end of the sheet 137 are guided from the respective non-protruding portions of the upper surface 93 toward the respective ridge portions 90 via the respective inclined surfaces 99 (see FIG. 3), so that the widthwise opposite end portions 124 of the leading end of the sheet 137 are mounted on the respective ridge portions 90. Consequently, the leading end of the sheet 137 is warped such that the widthwise opposite end portions 124 are positioned in respective positions higher than a position of the widthwise central portion 123. That is, the leading end of the sheet 137 is warped to have a downwardly convex shape in its cross section that is parallel to the width direction 16, i.e., perpendicular to the discharging direction 17. Thus, in the present embodiment, the ridge portions 90 are located in respective positions corresponding to the widthwise opposite end portions 124 of the leading end of the sheet 137 that are located on respective opposite sides of the curved central portion 123 of the leading end of the sheet 137.

As shown in FIG. 8B, when the A4-sized sheet 135 is discharged onto the sheet exit tray 21, the sheet 135 is conveyed in the discharging direction, with a widthwise central portion 113 of the leading end of the sheet 135 being moved along the widthwise intermediate portion of the upper surface 93 of the expansion tray 96, and with widthwise opposite end portions 114 of the leading end of the sheet 135 being moved along the respective plateau portions 92. Thus, the sheet 135 is conveyed to the stopper 62, with the leading end being substantially straight in its cross section (that is parallel to the width direction 16, i.e., perpendicular to the discharging direction 17), although the widthwise opposite end portions 114 are positioned in respective positions slightly higher than a position of the widthwise central portion 113.

There will be described an operation for discharging the recording sheets. When the A4-sized sheets 135 are held by the upper tray 20, the sheet sheet-supplying cassette 10 is contracted (see FIGS. 1 and 3). With the first pickup roller 25 (see FIG. 2) being rotated in a state in which the sheet-supplying cassette 10 is disposed in the main body of the printer 100, an uppermost one of the A4-sized sheets 135 is supplied from the upper tray 20 to the first sheet path 43 and third sheet path 23. While being conveyed along the third sheet path 23 by the sheet conveyor 30, the A4-sized sheet 135 is subjected to an image recording operation performed by the image recorder 24. Then, the A4-sized sheets 135 is further conveyed in the discharging direction 17 so as to be discharged from the third sheet path 23 onto the sheet exit tray 21.

In a state, as shown in FIG. 3, where the sheet-supplying cassette 10 is contracted, the protruding contact portions 67 of the stopper 62 are distant from the front end 97 of the tray main body 95 in the discharging direction 17 by a distance that is substantially equal to a length of the A4-sized sheet 135. Therefore, the leading end of the A4-sized sheet 135 is brought into contact with the protruding contact portions 67 of the stopper 62 after discharge of the sheet 135 has been completed (see FIG. 9). After the sheet 135 has been brought into contact at its leading end with the protruding contact portions 67, the sheet 135 is held by the sheet exit tray 21 with its leading end being held in contact with the protruding contact portions 67, as shown in FIG. 9. Since the leading end of the sheet 135 is thus stopped by the protruding contact portions 67, the sheet 135 is prevented from dropping from the sheet exit tray 21.

There is a case where the lower tray 140 holding the A3-sized sheets 137 is used while the sheet-supplying cassette 10 is being contracted (such that the above-described distance is substantially equal to the length of the A4-sized sheets 135) as shown in FIG. 1. With the second pickup roller 45 (see FIG. 2) being rotated in a state in which the lower tray 140 and the sheet-supplying cassette 10 are disposed in the main body of the printer 100, an uppermost one of the A3-sized sheets 137 is supplied from the lower tray 140 to the second sheet path 44 and third sheet path 23. While being conveyed along the third sheet path 23 by the sheet conveyor 30, the A3-sized sheet 137 is subjected to an image recording operation performed by the image recorder 24. Then, the A3-sized sheets 137 is further conveyed in the discharging direction 17 so as to be discharged from the third sheet path 23 onto the sheet exit tray 21. Since the ridge portions 90 are provided on the upper surface 93 of the sheet exit tray 21, the A3-sized sheet 137 discharged onto the sheet exit tray 21 is warped by the ridge portions 90 so as to have a downwardly convex shape (see FIG. 8C), whereby the sheet 137 is made difficult to be bent or curved in the discharging direction 17.

The A3-sized sheet 137 is larger in length as measured in the discharging direction 17 than the A4-sized sheet 135. Therefore, the leading end of the A3-sized sheet 137 is brought into contact with the stopper 62 before discharge of the sheet 137 is completed. That is, the stopper 62 is located on an upstream side of the leading end of the A3-sized sheet 137 (that has been completely discharged) in the discharging direction 17. Therefore, the A3-sized sheet 137 is further conveyed by the sheet conveyor 30 even after the leading end of the sheet 137 has been brought into contact with the stopper 62.

Figure 10:
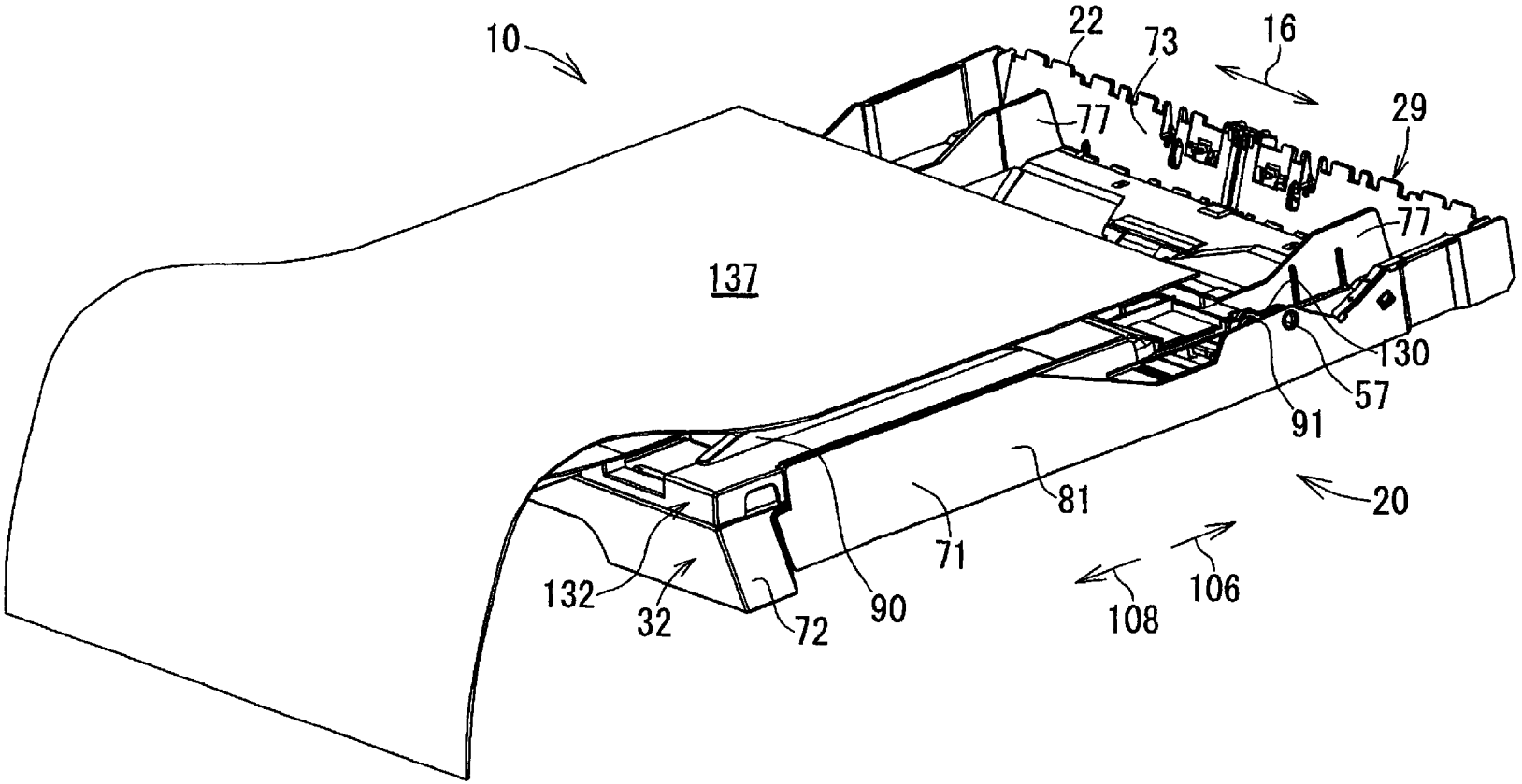
FIG. 10 is a perspective view showing the sheet-supplying cassette 10 in a state in which A-3 sized sheet 137 is received on the sheet exit tray 21.

The leading end of the A3-sized sheet 137 is guided along the guide surface (see FIG. 6) of the stopper 62 in the discharging direction 17, more precisely in this instance, in a diagonal upward direction. When the leading end of the sheet 137 reaches the distal end 70 of the guide plate 63, the widthwise central portion 123 of the leading end of the sheet 137 is positioned in the space 64 while opposite side portions of the leading end of the sheet 137 (which are located on respective opposite sides of the central portion 123) are brought into contact with the respective protruding contact portions 67. As a result of conveyance of the sheet 137 along the sheet exit tray 21, the curved central portion 123 (see FIG. 8C) of the leading end is given a higher rigidity than the opposite side portions of the leading end. The curved central portion 123 having the higher rigidity is not brought into contact with the guide plate 63 since the space 64 is constituted by the cutout 66 so as to be defined between the protruding contact portions 67 in the width direction 16. Therefore, the central portion 123 of the leading end of the sheet 137 passes through the cutout 66, and is moved onto a downstream side of the stopper 62 owing to a conveying force applied to the sheet 137 from the sheet conveyor 30 or a discharging force applied to the sheet 137 from the discharging roller set 39 as a sheet discharger. Meanwhile, the opposite side portions of the leading end of the sheet 137 having the lower rigidity easily passes over the respective protruding contact portions 67. Thus, the leading end of the sheet 137 passes over the stopper 62, and is moved onto the downstream side of the stopper 62 (see FIG. 10).

In the present embodiment, the discharging roller set 39 as the sheet discharger, the stopper 62 and the guide (that is constituted principally by the upper surface 93 of the expansion tray 96, the ridge portions 90 and the plateau portions 92) cooperate with each other to constitute a sheet conveying device. As described above, the recording sheet 137 discharged in the discharging direction 17 is received by the sheet exit tray 21 that is provided with the ridge portions 90 as the upwardly protruding portions, whereby the sheet 137 is given a high degree of rigidity and is accordingly made difficult to be bent in the discharging direction 17, so that the sheet 137 can pass over the protruding contact portions 67 without the sheet 137 being bent in the discharging direction, although the leading end of the sheet 137 is brought into contact with the protruding contact portions 67. Consequently, it is possible to prevent jamming of the sheet 137.

In the present embodiment, when the A4-sized sheet 135 as a relatively small-sized sheet is received by the sheet exit tray 21, the leading end of the sheet 135 is stopped by the stopper 62, with the leading end of the sheet 135 being inhibited from passing over the stopper 62. The sheet 135 is not substantially warped since the ridge portions 90 are located outside the widthwise opposite ends of the sheet 135. When the A3-sized sheet 137 as a relatively large-sized sheet is received by the sheet exit tray 21, the sheet 137 is further conveyed by the discharging force applied to the sheet 137 from the discharging roller set 39 as the sheet discharger even after the leading end of the sheet 137 has been brought into contact with the stopper 62. The sheet 137 is warped by the ridge portions 90 to have the downwardly convex shape in its leading end while being conveyed along the sheet exit tray 21, and the leading end of the sheet 137 passes over the stopper 62. Thus, only the recording sheet having a size that causes jamming (i.e., only the A3-sized sheet 137 in the present embodiment) is warped to have the downwardly convex shape in its leading end, for thereby preventing jamming of the sheet 137.

Further, in the present embodiment, the ridge portions 90 extend in the discharging direction 17. This arrangement is effective to increase the rigidity of the A3-sized sheet 137 for thereby facilitating the leading end of the sheet 137 to pass over the stopper 62. Thus, it is possible to further reliably prevent jamming of the sheet 137.

The leading end of the A3-sized sheet 137 is brought into contact with the stopper 62 before discharge of the sheet 137 is completed also in a case where the sheet exit tray 21 is contracted to have a length adapted for the A4-sized sheets 135 while the upper tray 20 holds the A3-sized sheets 137. In the sheet conveying device constructed according to the invention, it is possible to prevent jamming of the sheet 137 also in such a case.

While the presently preferred embodiment of the present invention has been described above in detail, it is to be understood that the invention is not limited to the details of the illustrated embodiment, but may be otherwise embodied.

Figure 11:
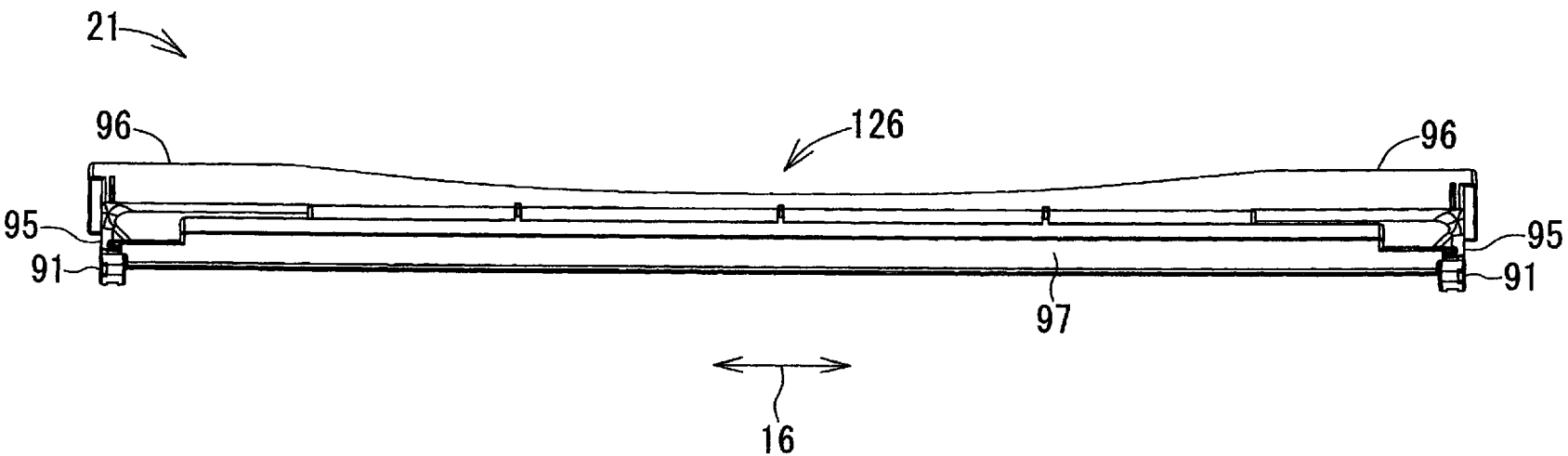
FIG. 11 is a view showing a modification of the sheet exit tray 21 as seen from its upstream side, wherein an upper surface of an expansion tray 96 is at least partially provided by a curved surface 126.

FIG. 11 shows a modification of the sheet exit tray 21 in which the ridge portions 90 and the plateau portions 92 are replaced with a curved surface 126 that is provided on the upper surface 93 of the expansion tray 96. The curved surface 126 has a height which is minimized in its widthwise central portion corresponding to the curved central portion 123 of the sheet 137 and which is gradually increased as viewed in a direction away from the widthwise central portion toward each of its widthwise opposite end portions. In this modification of FIG. 11 in which the curved surface 126 constitutes the guide, the discharged sheet 137 is warped to have the downwardly convex shape in its leading end, while being in contact with the curved surface 126. That is, the guide may have a configuration that is not particularly limited, as long as the guide is configured to warp the discharged sheet 137 such that the warped sheet 137 has a downwardly convex shape in its cross section thereof that is perpendicular to the discharging direction 17.

Figure 12:
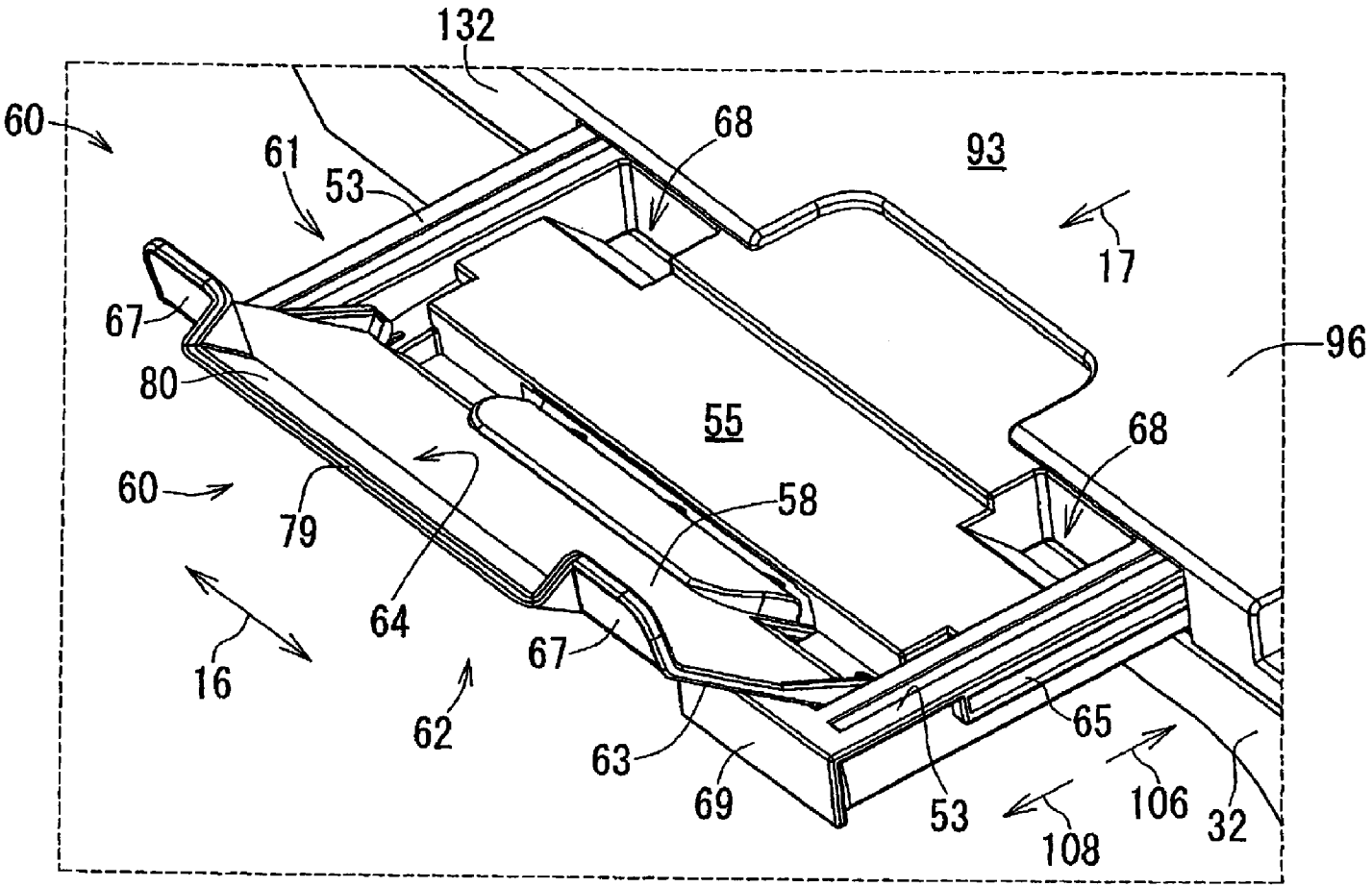
FIG. 12 is a perspective view showing, in enlargement, a modification of a guide plate 63 of the extension tray 60 in which a recessed portion 79 is provided between a pair of protruding contact portions 67 of the guide plate 63.

FIG. 12 shows a modification of the guide plate 63 of the extension tray 60 in which a recessed portion 79 is provided between the pair of protruding contact portions 67. A bottom surface 80 of the recessed portion 79 is inclined with respect to the guide surface 58 of the guide plate 63, toward an upstream side in the discharging direction 17. The protruding contact portions 67 are further inclined with respect to the bottom surface 80 of the recessed portion 79, toward an upstream side in the discharging direction 17. Owing to the provision of the recessed portion 79, the space 64 is defined between the protruding contact portions 67 in the width direction 16, and serves as the non-contact portion with which the central portion 123 (see FIG. 8C) of the leading end of the sheet 137 is not brought into contact. The leading end of the sheet 137 is brought into contact with the bottom surface 80 of the recessed portion 79 after being brought into contact with the protruding contact portions 67. Specifically described, as the sheet 137 is moved along the guide surface 58 in a diagonally upward direction, the opposite side portions of the leading end of the sheet 137 (which are located on the respective opposite sides of the central portion 123) are brought into contact with the respective protruding contact portions 67. Then, as the sheet 137 is moved further in the discharging direction 17, the central portion 123 of the leading end is brought into contact with the bottom surface 80 while the opposite side portions of the leading end are passing over the respective protruding contact portions 67. Thus, the leading end of the sheet 137 is moved onto the downstream side of the stopper 62 without the leading end being stopped by the protruding contact portions 67 of the stopper 62.

Figure 13:
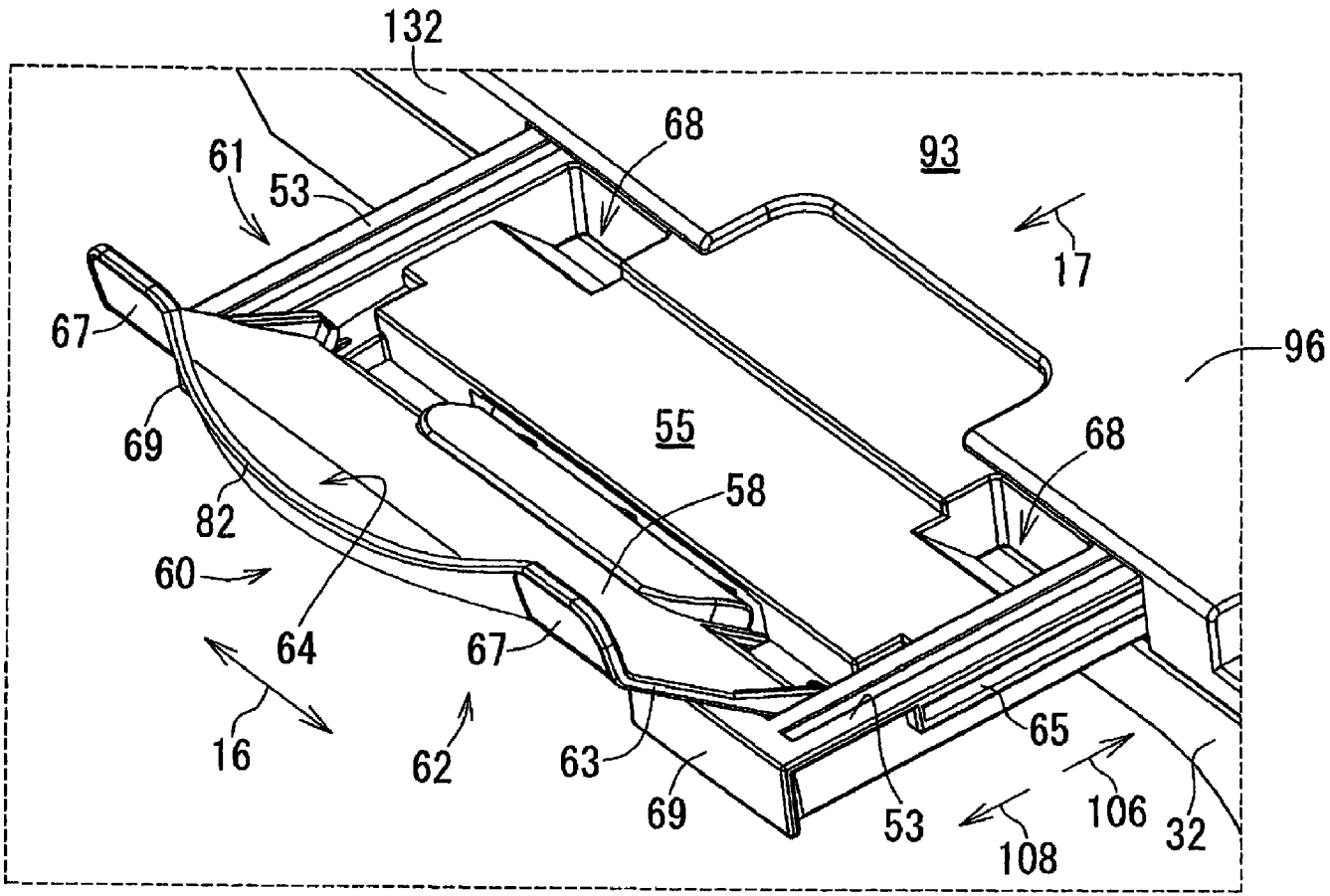
FIG. 13 is a perspective view showing, in enlargement, another modification of the guide plate 63 in which a curved recessed portion 82 is provided between the protruding contact portions 67.

FIG. 13 shows another modification of the guide plate 63 in which a curved recessed portion 82 is provided between the protruding contact portions 67. The curved recessed portion 82 has a curved bottom surface which is curved to be recessed, relative to an imaginary straight surface interconnecting the protruding contact portions 67, toward a downstream side in the discharging direction 17. Thus, the space 64 can be defined also by the provision of the curved recessed portion 82 between the protruding contact portions 67.

Figure 14:
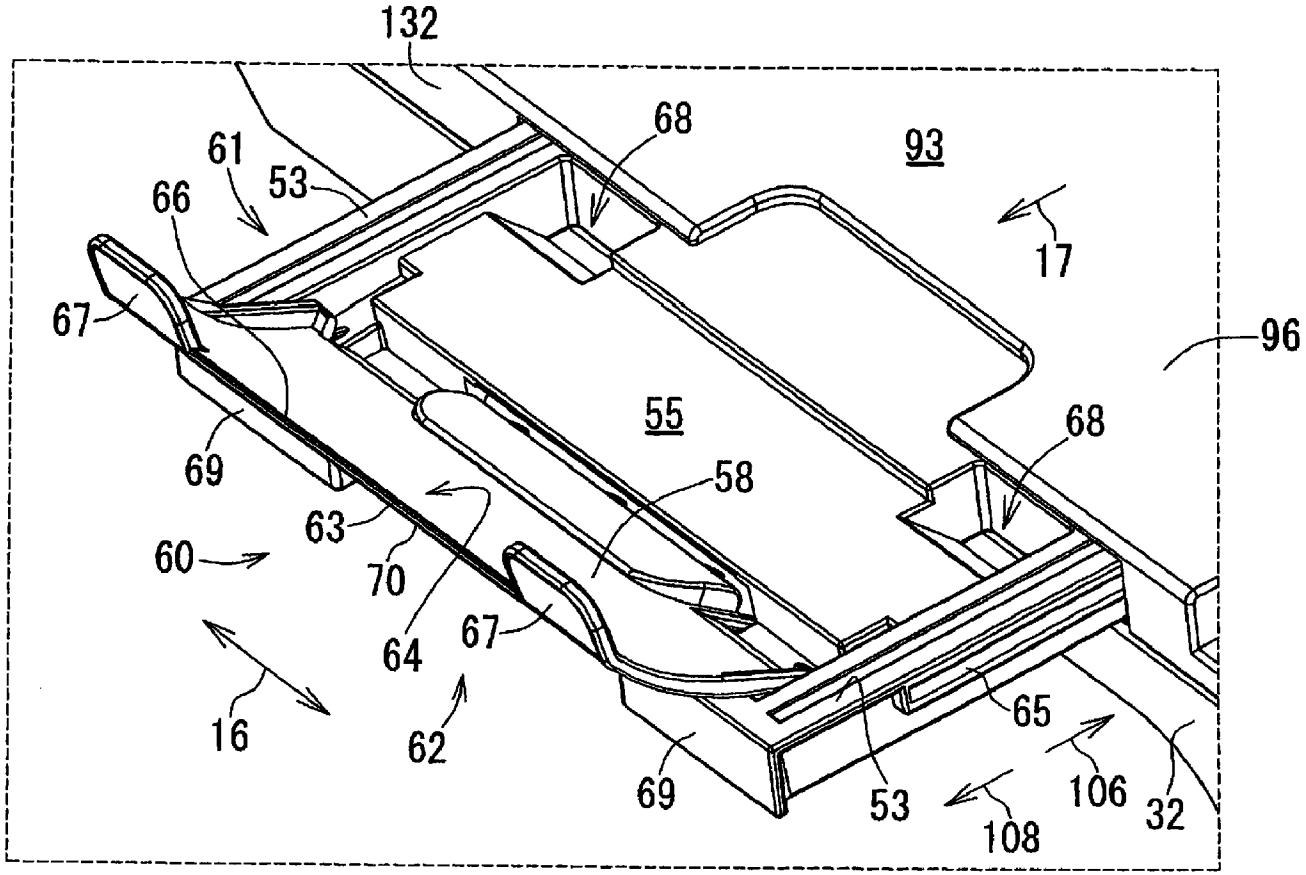
FIG. 14 is a perspective view showing, in enlargement, another modification of the guide plate 63 in which a guide surface 58 of the plate 63 is curved.
Figure 15:
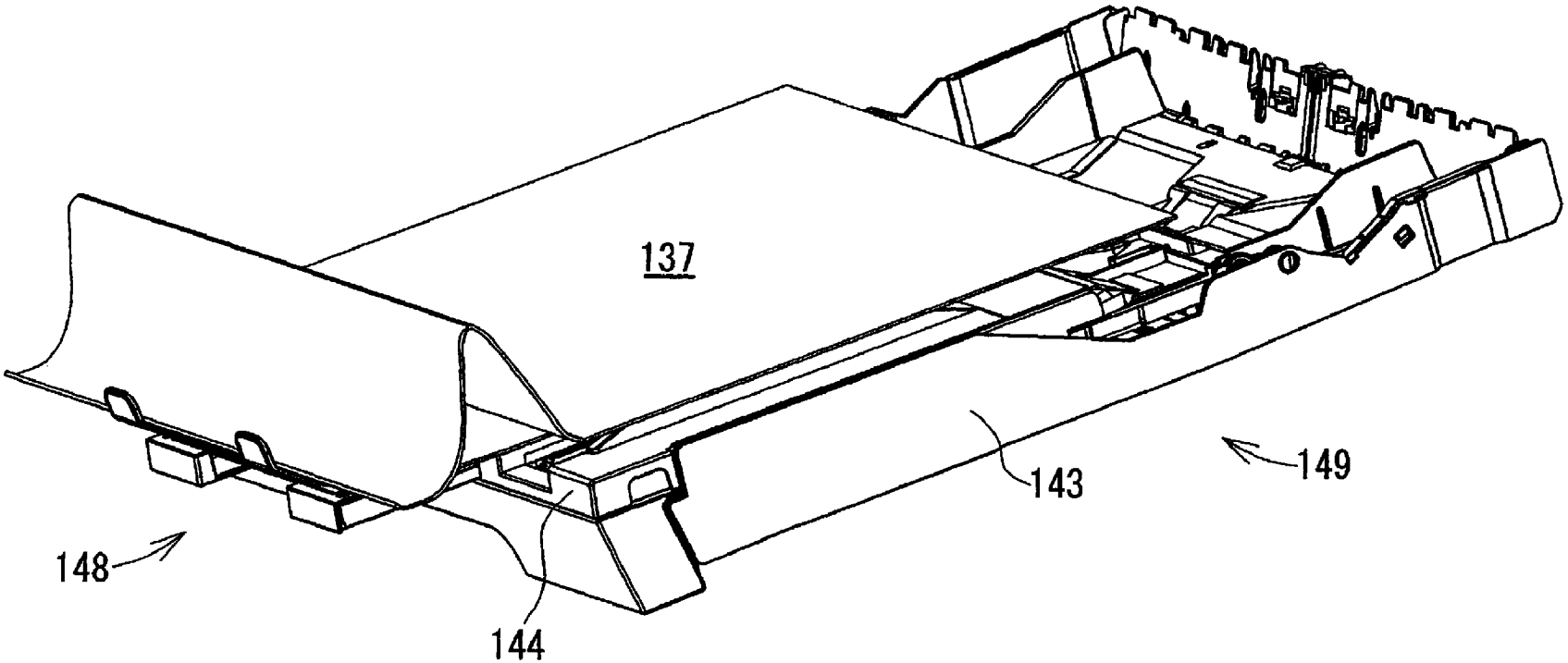
FIG. 15 is a perspective view showing a conventional sheet-supplying cassette 149 in a state in which A3-sized sheet 137 is received on a sheet exit tray 144 with its leading end being stopped by a stopper 148.

FIG. 14 shows another modification of the guide plate 63 in which the guide surface 58 is curved. In this modification, the guide surface 58 has a curved shape in its cross section that is parallel to the discharging direction 18 such that a degree of inclination of the guide surface 58 with respect to the protruding contact portions 67 is gradually reduced as viewed in the discharging direction 18. In other words, the guide surface 58 is curved such that the leading end of the sheet 137 is gradually directed to the protruding contact portions 67 as the sheet 137 is guided along the guide surface 58. Thus, the leading end of the sheet 137 describes a curve while being upwardly guided along the guide surface 58. Owing to this arrangement, the opposite side portions of the leading end of the sheet 137 (which are located on the respective opposite sides of the central portion 123) are guided along the respective protruding contact portions 67, thereby further facilitating the leading end of the sheet 137 to pass over the stopper 62.

In the above-described embodiment, the A4-sized sheet corresponds to the relatively small-sized sheet while the A3-sized sheet corresponds to the relatively large-sized sheet. However, such correspondences may be changed depending on a maximum-sized sheet acceptable by the printer 100. For example, where the maximum-sized sheet acceptable by the printer 100 is the A4-sized sheet, the A4-sized sheet may correspond to the relatively large-sized sheet while the A5-sized sheet may correspond to the relatively small-sized sheet.

Further, in the above-described embodiment, the ridge portions 90 extend in the discharging direction 17. However, the ridge portions 90 do not necessarily have to extend in the discharging direction 17, as long as the widthwise opposite end portions of the sheet 137 can be raised by the ridge portions 90.

Further, in the above-described embodiment, the guide plate 63 has a flat plate-like shape. However, the guide plate 63 may be otherwise shaped, for example, such that a widthwise central portion of a distal end of the guide plate 63 is distant from the leading end of the sheet 137 as compared with widthwise opposite end portions of the distal end of the guide plate 63.

Further, in the above-described embodiment, the sheet conveying device according to the invention is installed in the printer 100. However, the sheet conveying device may be used as an automatic document feeder to convey a document carrying an image that is to be read by a scanner apparatus.

What is claimed is:

1. A sheet conveying device comprising:

(a) a sheet discharger configured to discharge a sheet in a discharging direction;

(b) a tray configured to receive the sheet discharged by said sheet discharger;

(c) a stopper protruding upwardly from said tray; and (d) a guide provided by an upper surface of said tray and located on an upstream side of said stopper in the discharging direction, and configured to warp the discharged sheet such that the warped sheet has a downwardly convex shape in a cross section thereof that is perpendicular to the discharging direction, for thereby allowing a leading end of the warped sheet to pass over said stopper and to be positioned on a downstream side of said stopper in the discharging direction.

2. The sheet conveying device according to claim 1, wherein said stopper is configured to stop a small-sized sheet that is smaller in size than the sheet as a large-sized sheet, by inhibiting a leading end of the small-sized sheet from passing over said stopper, when the small-sized sheet is discharged by said sheet discharger.

3. The sheet conveying device according to claim 2, wherein said guide includes (d-1) widthwise opposite end portions which are opposite to each other in a width direction perpendicular to the discharging direction and (d-2) a widthwise intermediate portion which is located between said widthwise opposite end portions in the width direction, such that each of said widthwise opposite end portions has a height larger than a height of said widthwise intermediate portion, wherein said tray is configured to receive the small-sized sheet as a rectangular sheet such that widthwise opposite ends of the received small-sized sheet is positioned inside said widthwise opposite end portions of said guide in the width direction and such that the leading end of the received small-sized sheet is brought into contact with said stopper after discharge of the received small-sized sheet by said sheet discharger has been completed, and wherein said tray is configured to receive the large-sized sheet as another rectangular sheet such that widthwise opposite ends of the received large-sized sheet is positioned outside said widthwise opposite end portions of said guide in the width direction and such that the leading end of the received large-sized sheet is brought into contact with said stopper before discharge of the received large-sized sheet by said sheet discharger is completed.

4. The sheet conveying device according to claim 1, wherein said stopper includes (c-1) contact portions that are to be in contact with respective portions of the leading end of the warped sheet that are located on respective opposite sides of a curved central portion of the leading end of the warped sheet and (c-2) a non-contact portion that is not to be in contact with the curved central portion of the leading end of the warped sheet.

5. The sheet conveying device according to claim 4, wherein said stopper includes a guide surface configured to guide the leading end of the warped sheet toward said contact portions.

6. The sheet conveying device according to claim 5, wherein said guide surface is a curved surface.

7. The sheet conveying device according to claim 1, wherein said guide includes (d-1) widthwise opposite end portions which are opposite to each other in a width direction perpendicular to the discharging direction and (d-2) a widthwise intermediate portion which is located between said widthwise opposite end portions in the width direction, such that each of said widthwise opposite end portions has a height larger than a height of said widthwise intermediate portion.

8. The sheet conveying device according to claim 7, wherein said guide includes upwardly protruding portions as said widthwise opposite end portions such that said upwardly protruding portions are located in respective positions corresponding to respective portions of the leading end of the warped sheet that are located on respective opposite sides of a curved central portion of the leading end of the warped sheet.

9. The sheet conveying device according to claim 8, wherein said upwardly protruding portions of said guide extend in the discharging direction.

10. The sheet conveying device according to claim 1, wherein said guide has a curved surface downwardly concaved in an intermediate portion thereof that is intermediate in a width direction perpendicular to the discharging direction.

11. The sheet conveying device according to claim 1, wherein said stopper is movable in the discharging direction.

12. The sheet conveying device according to claim 11, wherein said stopper protrudes upwardly from a downstream end portion of said tray in the discharging direction, and wherein said tray is expandable and contractible in the discharging direction whereby said stopper is movable in the discharging direction.

13. An image recording apparatus comprising:

the sheet conveying device defined in claim 1;

a second tray capable of holding a sheet of any one of various sizes, so as to hold the sheet of a selected one of the various sizes;

an image recorder configured to record an image onto the sheet; and a sheet supplier capable of supplying the sheet from said second tray to said image recorder, so that the image is recorded onto the sheet supplied by said sheet supplier, wherein said sheet discharger is configured to discharge the sheet onto which the image has been recorded, onto said tray as a first tray.

14. The image recording apparatus according to claim 13, further comprising a third tray capable of holding a sheet different in size from the sheet held by said second tray, wherein said sheet supplier is capable of supplying the sheet from said third tray in addition to the sheet from said second tray, so as to supply a selected one of the sheet from said second tray and the sheet from said third tray.

* * * * *